United States Patent [19]

Sasaki et al.

[11] Patent Number: 4,873,547

[45] Date of Patent: Oct. 10, 1989

[54] SHEET CONVEYING APPARATUS

[75] Inventors: Nobukazu Sasaki, Tokyo; Toshirou Kasamura, Yokohama; Masashi Ohashi, Tokyo; Naoki Okuda, Kawasaki; Toshihiko Kusumoto, Tokyo; Yasunori Maeda, Inagi; Takashi Ozawa, Ichikawa; Yasuyoshi Yamamoto, Tokyo; Atsushi Kubota, Machida; Akiyoshi Kimura, Tokyo; Makoto Masuda, Toride, all of Japan

[73] Assignee: Canon Kabushiki Kaisha, Tokyo, Japan

[21] Appl. No.: 311,380

[22] Filed: Feb. 16, 1989

Related U.S. Application Data

[63] Continuation of Ser. No. 97,662, Sep. 16, 1987, abandoned.

[30] Foreign Application Priority Data

| | | | |
|---|---|---|---|
| Sep. 18, 1986 | [JP] | Japan | 61-220511 |
| Sep. 18, 1986 | [JP] | Japan | 61-220512 |
| Dec. 26, 1986 | [JP] | Japan | 61-311579 |
| Jan. 8, 1987 | [JP] | Japan | 62-002841 |

[51] Int. Cl.[4] ..... G03G 15/00; B65H 3/04

[52] U.S. Cl. ..... 355/316; 355/50; 271/34

[58] Field of Search ..... 355/3 SH, 14 SH, 24, 355/26, 50; 271/34, 186

[56] References Cited

U.S. PATENT DOCUMENTS

| | | | |
|---|---|---|---|
| 4,074,902 | 2/1978 | Bradbury | 271/34 |
| 4,093,372 | 6/1978 | Guenther | 355/50 |
| 4,172,655 | 10/1979 | Wood | 355/26 |
| 4,365,794 | 12/1982 | Roller | 271/186 |
| 4,573,789 | 3/1986 | Wada | 355/14 SH |
| 4,621,921 | 11/1986 | Takahata et al. | 355/14 SH |

FOREIGN PATENT DOCUMENTS

| | | |
|---|---|---|
| 2806696 | 10/1978 | Fed. Rep. of Germany . |
| 28669 | 2/1985 | Japan . |

*Primary Examiner*—Donald A. Griffin

*Attorney, Agent, or Firm*—Fitzpatrick, Cella, Harper & Scinto

[57] ABSTRACT

An image forming apparatus includes sheet accommodating cassette for accommodating sheets, a device for forming images on the sheets, a first sheet conveying passage for conveying the sheet to the image forming device from the sheet accommodating cassette, a conveyor for accommodating a bundle of sheets having been subjected to an image forming operation by the image forming means at first sides thereof in a form in which leading edges of the sheets are gradually deviated in a sheet advancement direction, and for conveying the bundle as a whole, a feeder, disposed downstream of the conveyor with respect to the sheet advancement direction, for feeding one by one the sheets of the bundle from the sheet closest to the feeder, a second sheet conveying passage merging into the first passage for refeeding to the image forming device the sheets fed by the feeder, and a confining device for confining the sheets of the bundle other than the sheet being fed by the feeder.

46 Claims, 24 Drawing Sheets

(a)

(b)

(c)

SHEET CONVEYING APPARATUS

This application is a continuation of application Ser. No. 097,662 filed Sept. 16, 1987, now abandoned.

FIELD OF THE INVENTION AND RELATED ART

The present invention relates to a sheet conveying apparatus for an image forming apparatus such as a copying machine and a laser beam printer, more particularly to such a sheet conveying apparatus for a duplex or superimposed image forming apparatus that a preset number of sheets having images on first sides are once stored for the purpose of forming additional images on the same (superimposing mode) or opposite sides (duplex mode).

An image forming apparatus such as a copying apparatus, which will hereinafter be called simply a copying apparatus, is known wherein there is provided an intermediate tray or the like to once store a sheet or sheets having an image on their first side that is refed to an image forming station so as to provide a duplex copy (a copy having formed images on both of its sides) or to provide a superimposed copy (a copy which has on its one side a superimposed image which is a combination of images). Recently, those copying machines are considered convenient. Some image forming apparatus is equipped with a masking function by which during a latent image formation at the image forming station, the latent image is erased in a preselected area by, for example controlling light sources which may be light emitting diodes (LED). By combining this function with the above described superimposing image forming function, images can be synthesized, or if plural developing devices are used, color synthesization is possible.

Usually, in this type of image forming apparatus, in order to enable continuous duplex or superimposing image forming operation, plural sheets having images on the first sides are once stacked on an intermediate tray within the image forming apparatus, and then they are refed one by one to the image forming station. Since, however, the sheets stored in the intermediate tray are free without confinement by any sheet conveying means, an alignment means is needed in order to prevent the sheets from being fed obliquely. Additionally, in order to avoid a double feeding, a sheet separating mechanism is required in the sheet refeeding station. Because of those factors, a complicated structure has not been avoidable.

U.S. Pat. No. 4,172,655 discloses a sheet separating mechanism. In an intermediate tray the sheets are fed outwardly by a conveying roller immediately after and each time a sheet is discharged onto the intermediate tray so that the sheets are stacked stepwisely. The bundle of the stacked sheets are fed by a conveyor to a feed-out means, which feeds out the sheets one by one to the image forming station. However, the sheets are fed out from the bottom, and therefore, the sheet or sheets stacked on the bottommost sheet are possibly fed out together with the bottommost sheet (double feeding). It should be noted that the double feeding is a particularly significant drawback in the duplex or superimposing image forming operation since if it occurs once, all the subsequent second images are formed on wrong sheets already having images on the opposite sides. In a simplex copying operation wherein images are formed on only first sides of copy sheets, the double feeding would not be so significant since it can be obviated simply by removing the additional white sheet from the resultant copies.

Japanese Laid-Open Patent Application Publication No. 28669/1985 discloses that sheets are fed out by a conveying roller immediately after and each time a sheet is discharged onto the intermediate tray to form a bundle of sheets which are stacked stepwisely. The bundle of sheets are inversed in the facing orientation, and thereafter, the sheets are refed from the topmost. Also in this case, however, the second sheet is confined only by friction with a belt, and therefore, the double feeding is liable to occur.

SUMMARY OF THE INVENTION

Accordingly, it is a principal object of the present invention to provide a sheet conveying apparatus usable with a duplex and/or superimposing image forming apparatus, wherein plural sheets having images on the first sides are stepwisely stacked with certainty and are refed one by one back to an image forming station with certainty.

It is another object of the present invention to provide a sheet conveying apparatus wherein the stepwisely stacked sheets are securedly separated one by one by preventing double feeding.

It is a further object of the present invention to provide a compact sheet conveying apparatus with a simple structure.

According to an embodiment of the present invention, a means is employed to positively confine the sheet or sheets other than the sheet to be fed out when the sheets are separated and refed one by one from a bundle of stepwisely stacked sheets, whereby the separation of a sheet is assured, and the double feeding is positively prevented.

According to an embodiment of the present invention, the size of the sheet feeding apparatus can be reduced by providing a turnout or refuge for receiving trailing edge portions of the sheet in the bundle stepwisely stacked on a tray.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
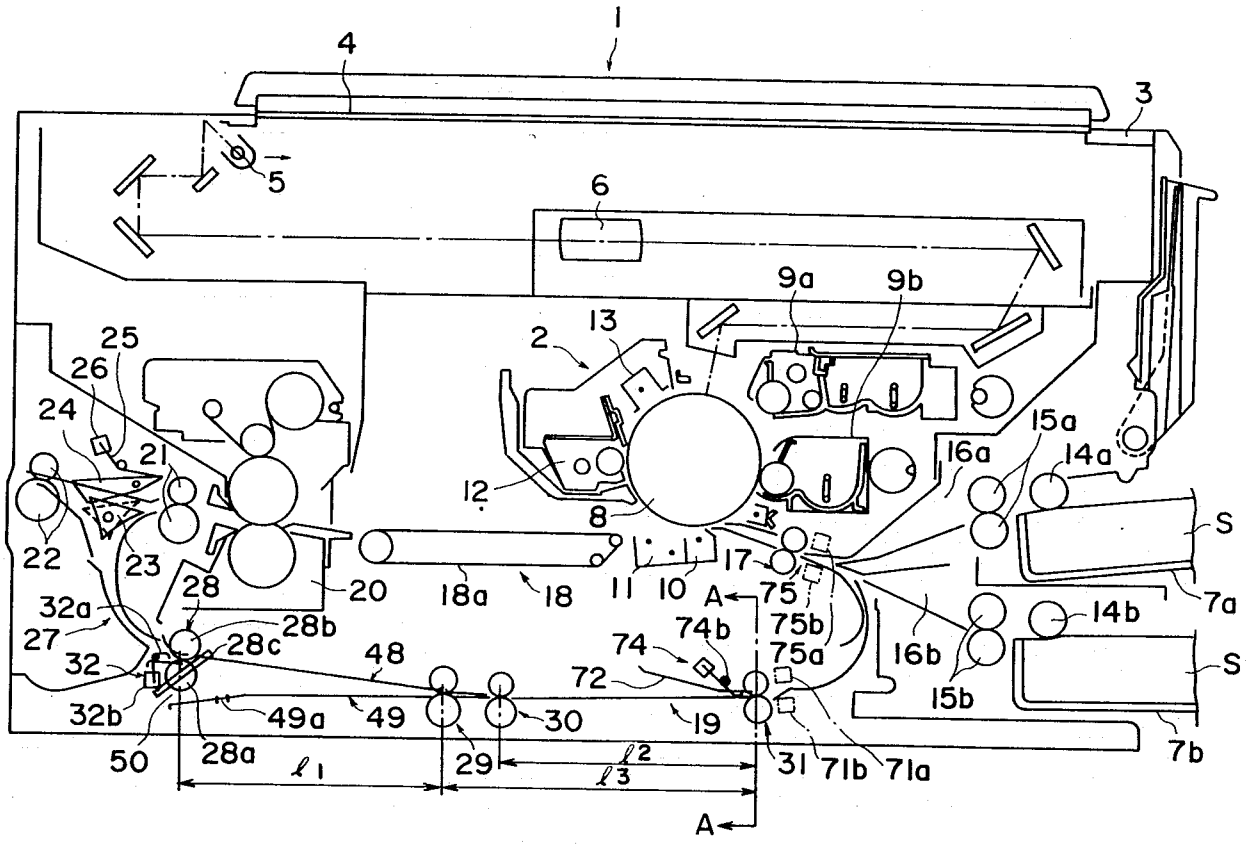
FIG. 1 is a sectional view of a general arrangement of an forming apparatus using a sheet conveying apparatus according to a first embodiment of the present invention.
Figure 9:
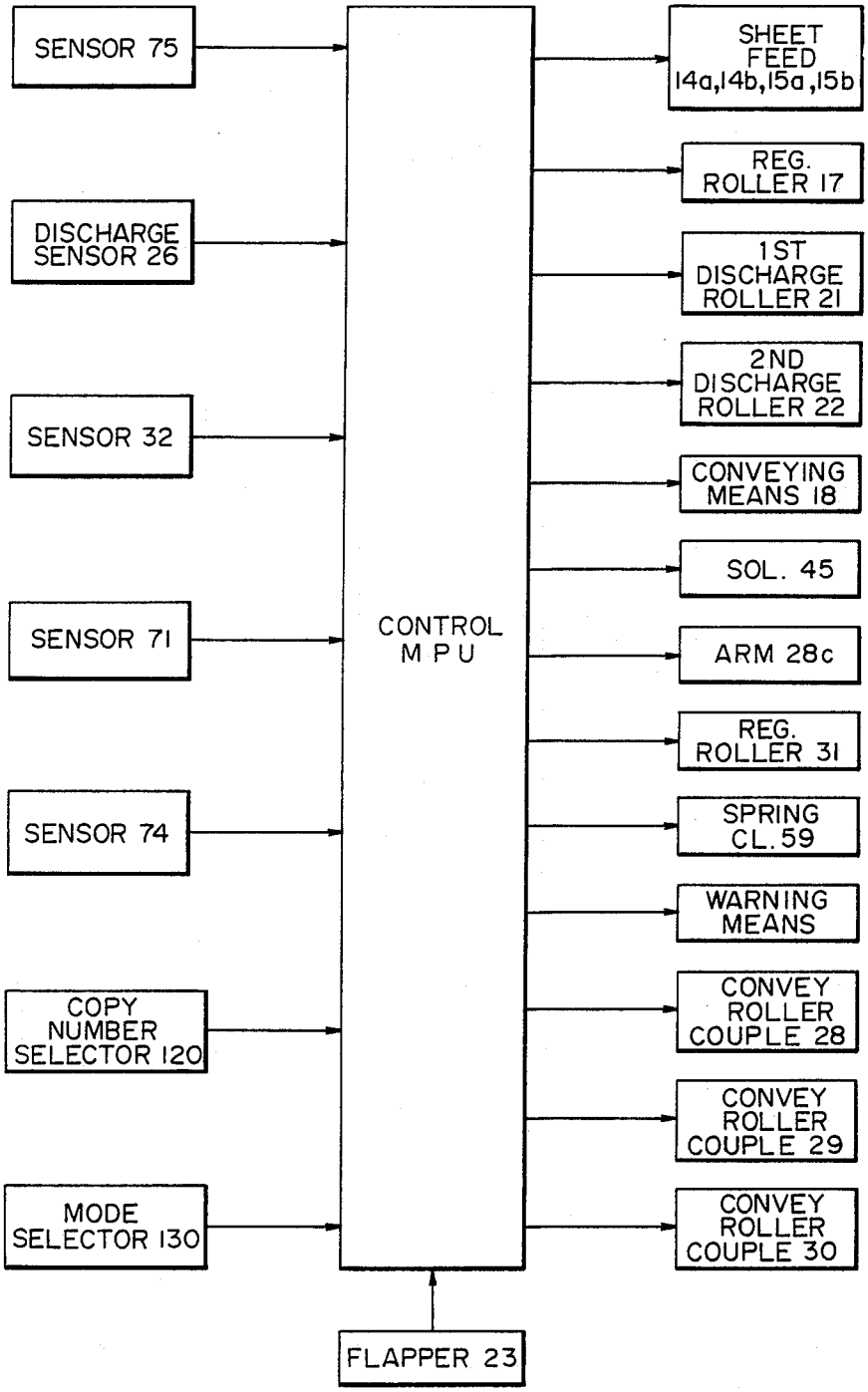
FIG. 9 is a block diagram illustrating a control system for the sheet feeding apparatus according to the first embodiment.
Figure 10:
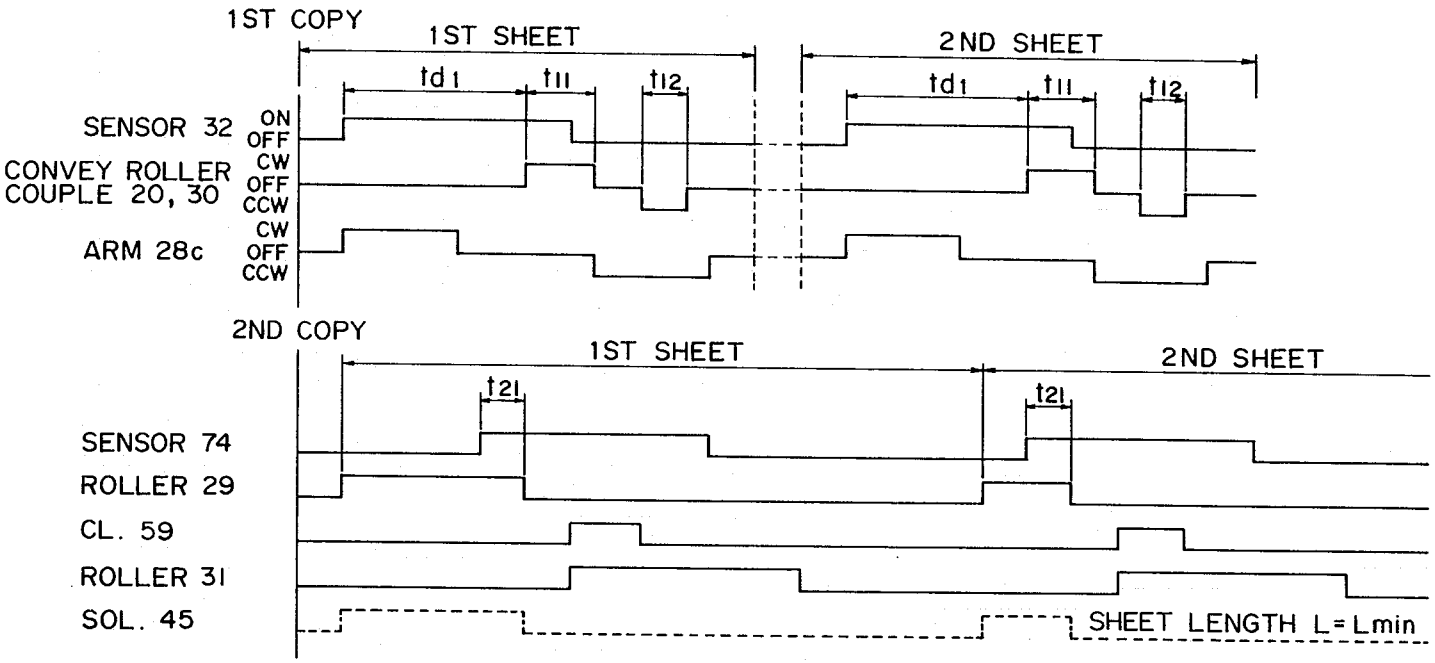
FIG. 10 is a time chart illustrating an operation of the sheet feeding apparatus according to the first embodiment.

Referring to FIG. 1, there is shown an image forming apparatus incorporating a sheet conveying apparatus according to a first embodiment of the present invention. FIGS. 2–8 illustrate the structure; FIG. 9 shows a control system; FIGS. 11A–11F are flow charts showing the operations; FIG. 10 is a time chart showing the operation. These figures refer to the first embodiment.

The image forming apparatus is shown as a copying apparatus 1 operable selectively in a duplex copying mode or a superimposing copy mode, wherein the modes may be selected by a selector means which is operatively coupled with a microprocessor unit MPU, as shown in FIG. 1. The copying apparatus 1 comprises a copy performing assembly 3 containing a copying station (image forming station) 2. The copy performing assembly 3 includes an original supporting platen 4, a light source 5, a lens system 6, two cassettes 7*a* and 7*b* and others. Adjacent a center of the assembly 3, the copying station 2 is disposed having a cylindrical photosensitive member 8 or the like. Around the surface of the photosensitive member 8, there are provided two developing devices 9*a* and 9*b* containing different color toners to provide a copy formed in different colors. The developing devices 9*a* and 9*b* are selectively set or reset by movement in the directions indicated by arrows. Downstream of the developing devices with respect to movement direction of the photosensitive member 8, there are a transfer charger 10, a separation charger 11, a cleaning device 12 and a primary charger 13. The image forming operation using those means may be of any conventional type, and therefore, the detailed description thereof is omitted.

Adjacent the cassettes 7*a* and 7*b*, pick-up rollers 14*a* and 14*b* are disposed to feed the sheets out one by one therefrom. Conveying roller couples 15*a* and 15*b* are effective to feed a sheet S through passages 16*a* and 16*b* to a registration roller couple 17. An additional sheet conveying passage 19 is extended to the registration roller couple 17 to guide a sheet S to the image forming station 2 for a second image forming operation for the superimposed or duplex copy. Downstream of the separation charger 11, there is a conveying passage 18 extending to an image fixing device 20. Downstream of the image fixing device 20, there is a first discharging roller couple 21, by which the sheet can be conveyed to a second discharging roller couple 22 to discharge the sheet out onto an external tray or the like. At a position between the first discharging roller couple 21 and the second discharging roller couple 22, there is provided a main flapper 23 and an auxiliary flapper 24. Usually, the sheet S discharged from the first discharging roller couple 21 is conveyed above the flapper 23 taking its solid line position in the Figure, and it swings by its interior the auxiliary flapper 24 in the direction of an arrow, in response to which a photosensor 26 is actuated through a detecting arm 25 by which the passage of the sheet is detected, while the sheet is discharged by the second discharging roller couple 22 to the outside tray or the like of the image forming apparatus. When the duplex copying mode is selected by a mode selector (FIG. 9), the sheet S is conveyed in that manner similar to the described above, but is discharged only partly by the second discharging roller couple 22. Then, at the instance when the trailing edge of the sheet is just released from the auxiliary flapper 24, the second discharging roller couple 22 is reversed through operations of the detecting arm 25 and the photosensor 26, by which the sheet is guided to the left side of the auxiliary flapper 24 and the flapper 23 and is introduced into the passage 27. Therefore, in the duplex copy mode, the sheet having the image on its first side is refed by the operations of the second discharging roller couple 22, the detecting arm 25, the photosensor 26 and the passage 27, so as to bring the second side of the sheet to the image forming station. When the superimposing mode is selected, the flapper 23 is pivoted to the broken line position, so that the sheet S discharged from the first discharging roller couple 21 is directly introduced to the passage 27 by the guiding function of the right side of the flapper 23. Therefore, in the superimposing mode, the sheet S is refed by the operations of the first discharging roller couple 21, the flapper 23 and the passage 27, so as to bring the same side to the image forming station. The sheet S received by the passage 27 is guided through a sheet passage 19 to the registration roller couple 17. The sheet passage 19 is provided with a conveying roller couple 28 constituting a conveying means, an additional conveying roller couples 29 and 30 constituting an additional conveying means and a lateral registration roller couple 31 which is shiftable in its longitudinal direction to align one lateral side of the sheet with respect to a reference position.

In the sheet conveying passage 19, the conveying roller couple 28 comprises a driving roller 28*a* and a follower roller 28*b* which are supported between front and rear frames of the apparatus. The driving roller 28*a* is driven by an unshown driving means in synchronism with an operation of the image forming assembly and is always rotating in the direction indicated by an arrow when the assembly 3 is in operation. Immediately upstream of the conveying roller couple 28*a*, there is disposed a sheet detecting sensor 32 including a detecting arm 32*a* and a photodetecting element 32*b*.

Figure 2:
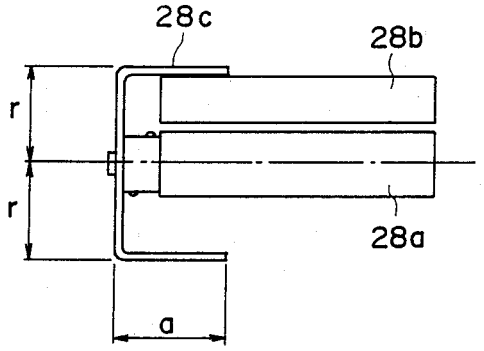
FIG. 2 is a front view of a part of the sheet conveying apparatus.

As shown in FIG. 2, coaxially with the driving roller 28*a*, an arm 28*c* having a radius r having a channel cross-section which constitutes an urging member is mounted for rotation about an axis of the roller 28*a*. The arm 28*c* is swingable by an unshown driving mechanism. The arm 28*c* has legs each having a length sufficient to be engaged to a minimum size of sheets usable with the sheet conveying apparatus.

Figure 3:
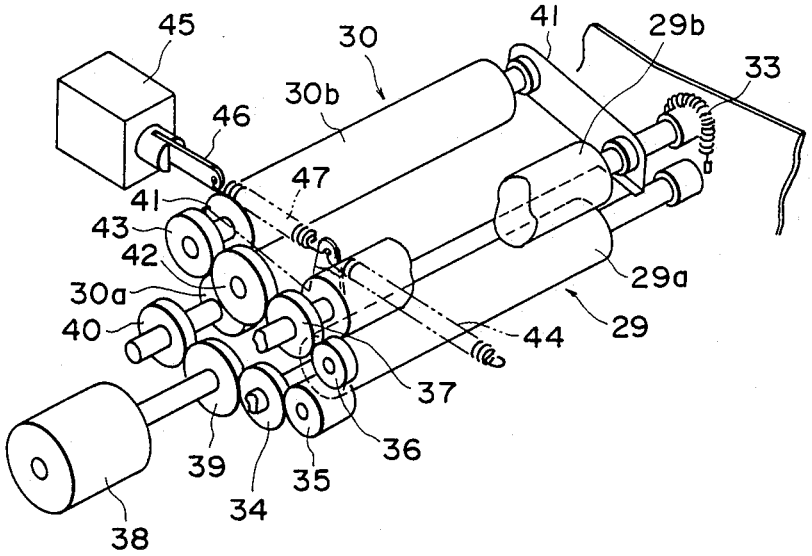
FIG. 3 is view of a perspective view of a reversible sheet conveying apparatus.

FIG. 3 shows details of conveying roller couples 29 and 30 disposed downstream of the conveying roller couple 28. The conveying roller couple 29 includes a driving roller 29*a* supported between front and rear frames of the apparatus and an upper roller 29*b* rotatably and substantially vertically displaceably (toward and away from the driving roller 29*a*) supported between the frame of the apparatus and is normally urged to the driving roller 29 by a spring 33 coupled to the bearings for the upper roller 29*b*. The driving roller 29*a* and the upper roller 29*b* are operatively coupled by a gear train including a gear 34 fixed to the driving roller 29*a* idler gears 35 and 36 and a gear 37 fixed to the upper roller 29*b* so as to make the peripheral speeds of the rollers 29*a* and 29*b* identical. The gear train is effective to maintain the operational relationship between rollers 29*a* and 29*b* even when the rollers are spaced apart by, for example, 1–2 mm.

The driving roller 29*a* is operatively coupled with a driving motor, that is a driving motor 28 in this embodiment through a gear 39. The pulse motor 38 is a reversible motor controlled by signals from an unshown control means. The driving roller 29*a* is, therefore, reversible. The amount of rotation is also controlled by the control means.

The conveying roller couple 30 disposed further downstream of the conveying roller couple 29 includes a driving roller 30*a* and an upper roller 30*b*. The driving roller 30*a* is supported in the same manner as the above described driving roller 29*a*. The driving roller 30*a* is driven at the same peripheral speed and in the same peripheral direction as that of the driving roller 29*a* by engagement between an input gear 40 fixed to the driving roller 30*a* and a gear 39 operatively coupled to the pulse driving motor 38. The upper roller 30*b* is journaled to arms 41 and 41 which is rotatable about an axis of the upper roller 29*b* of the conveying roller couple 29. The upper roller 30*b* is driven by the gear 43 fixed to the upper roller 30*b* through an idler gear 42 rotatably supported on an arm 41 and a gear 37 fixed to the above-described upper roller 29*b*. The upper roller rotates at the same speed as the driving roller 30*a*. A balancing spring 44 is stretched between the arm 41 and a frame of the assembly 3 so that the weights of the upper roller 30*b* and the arm 41 are overcome to normally urge the arm 41 to an upper stopper, and therefore, the rollers of the conveying roller couple 30 are normally spaced apart by about 2 mm clearance in this embodiment. An additional spring 47 is stretched between the arm 41 and a link 46 of the solenoid 45, extending in the opposite direction to the balancing spring 44. By operating the solenoid 45, the upper roller 30*b* can be urged to the driving roller 30*a*.

Referring back to FIG. 1, an upper guide plate 48 and a lower guide plate 49 are disposed between the conveying roller couple 28 and the conveying roller couple 29. The upper guiding plate 48 serves to guide the sheet passed through the conveying roller couple 28 to the conveying roller couple 29. The lower guide plate 49 has an end portion (left side in the Figure) extending to under the driving roller 28*a* to constitute a turnout 50 by the clearance formed between the lower guide plate 49 and the driving roller 28*a*. The extension of the lower guiding plate 49 is provided with slots 49*a* so as not to interfere with the arm 28*c* rotation (radius r).

A distance $l_1$ between the conveying roller couple 28 and the conveying roller couple 29 is set Lmin - $\alpha$, where Lmin is the minimum length, measured along the sheet conveying direction, of the sheet which can be conveyed by the sheet conveying apparatus, and $\alpha$ is a small margin to ensure the conveyance of the minimum length sheet. A distance $l_2$ between the conveying roller couple 30 and the registration roller couple 31 is set Lmin - $\beta$($\beta$ is a small margin). A distance $l_3$ between the conveying roller couple 29 and the registration roller couple 31 is set to be Lmax - $\beta$ so that a sheet having the maximum length measured along the conveying direction can be conveyed.

Figure 4:
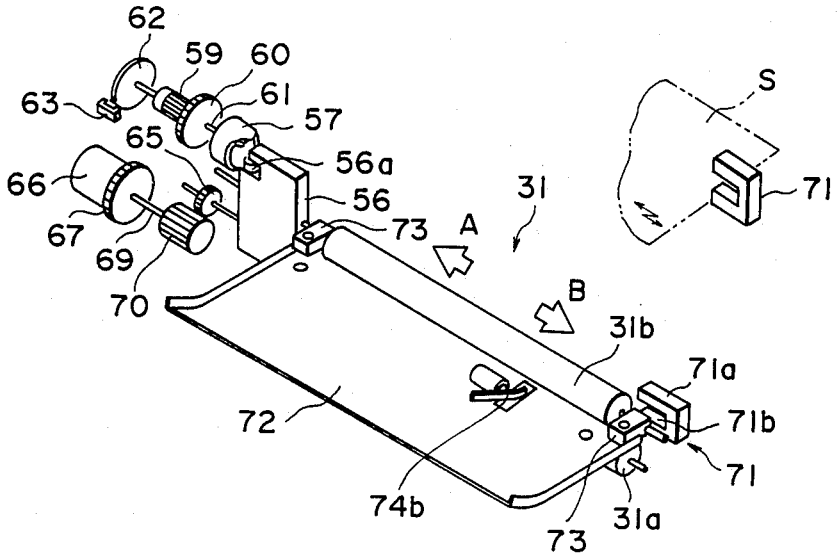
FIG. 4 is a perspective view of a lateral registration roller couple for correcting a lateral position of a sheet.
Figure 5:
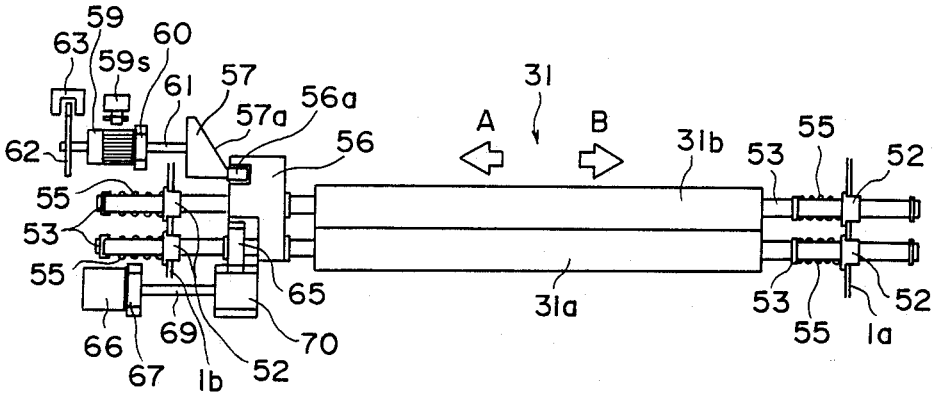
FIG. 5 is a front view of a roller couple of FIG. 4.

FIGS. 4 and 5 show the structure of the registration roller couple 31 shiftable in its longitudinal direction to correct the lateral position of the sheet, that is, in the direction perpendicular to the sheet conveyance direction. The registration roller couple 31 includes a lower roller 31*a* and an upper roller 31*b* press-contacted to each other. The upper roller 31*b* and the lower roller 31*a* are rotatably and slidably supported between front and rear frames 1*a* and 1*b* of the copying apparatus by bearings 52 and 52.

As shown in FIG. 5, the upper roller 31*b* and the lower roller 31*a* are normally urged leftwardly in this Figure by spring 55 which are compressed between the respective bearings 52 and collars 53 fixed to shaft ends of the associated rollers. The upper roller 31*a* and the lower roller 31*b* are supported on a block 56 for rotation only. The block 56 is contacted to a cam 57 through a roller 56*a* disposed above the block 56. The cam member 57 is a cylindrical cam in which longitudinal end surface of the cylinder is formed into a cam surface. When the spring clutch 59 is engaged by energization of the solenoid 59*s*, the rotational driving force from the driving gear 60 is transmitted to the shaft 61 through the clutch 59 to rotate the cam member 59. When it rotates through one full turn, the block 56, and therefore, the upper roller 31*b* and the lower roller 31*a* are shifted against the spring bias by the spring 55 in the direction indicated by references A and B (FIG. 4). Normally, the upper roller 31*b* and the lower roller 31*a* are maintained at their home positions, namely, the central position of the shift stroke by the center 57*a* of the cam surface of the cam member 57 contacting the roller 56*a* by a position regulation function provided by a photosensor 63 and a light interrupting plate 62 fixed to an end of the shaft 61. The lower roller 31*a* is provided with a gear 65 fixed thereto. When an electromagnetic clutch 66 is engaged so that the rotational driving force is transmitted from the driving gear 67 to the shaft 67 through the clutch 66 to rotate a transmission gear 70. Then, the gear 65 meshed with the gear 70 is rotated, whereby the lower roller 31*a* is rotated to convey the sheet S which is then stopped by its leading edge abutting to the nip between the upper roller 31*b* and the lower roller 31*a*.

As shown in FIG. 4, a photosensor 71 is disposed adjacent to the nip between the upper roller 31*b* and the lower roller 31*a*. The photosensor 71 includes a light emitting portion 71*a* containing an array of a number of light emitting elements parallel to the nip and a light receiving portion 71*b* containing an array of a number of light receiving element in association with the respective light emitting elements. The photosensor 71 serves to detect the lateral position of the sheet S.

Figure 6:
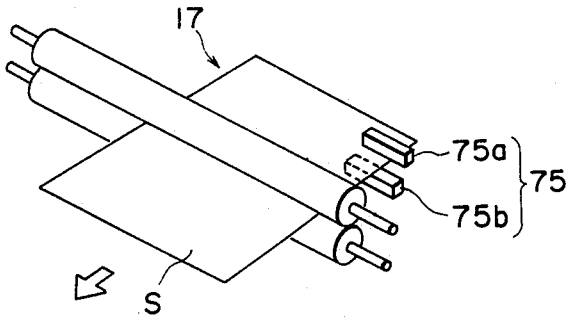
FIG. 6 is a perspective view of a couple of registration rollers.

As shown in FIG. 6, an additional photosensor 75 is provided, correspondingly to the photosensor 71, for the other registration roller couple 17, more particularly, upstream of the registration roller couple 17. The photosensor 75 is effective to detect the lateral position of the sheet when the sheet is subjected to the first image forming operation. The photosensor 75, similarly to the photosensor 71, is disposed adjacent to the registration roller couple 17 and is extended in a direction perpendicular to the sheet conveying direction, and is comprised of a light emitting portion 75*a* containing an array of a number of light emitting elements and a light receiving portion 75*b* containing an array of a number of light receiving elements.

Referring back to FIG. 4, designated by a reference 72 is an upper guiding plate for guiding the sheet to the nip between the upper roller 31*b* and the lower roller 31*a* and is mounted to the upper roller 31*b* through the blocks 73 and 73. Designated by a reference 74*b* is a detecting arm cooperable with a light detecting element 74*a* to form a sensor 74 for detecting the sheet coming thereto.

FIG. 9 is a block diagram for the control of the sheet conveying apparatus according to the first embodiment. As shown in this Figure, the microprocessing unit MPU receives detection signals from the above described various sensors, from copy number selector means 120 for instructing the desired number of copies and from mode selector means 130 for selectively setting a duplex copy mode or a superimposing copy mode or another mode.

FIG. 10 is a time chart illustrating the timed relationship in the operation of the apparatus.

FIGS. 11A–11F are flow charts illustrating the operation. FIGS. 10 and 11 are related to the operation wherein two copies are to be reproduced in duplex or superimposing mode.

The operation of the apparatus according to this embodiment will be described referring to FIGS. 10 and FIGS. 11A–11F.

Duplex or Superimposinq Operation for One Sheet

In this mode, when the copying operation is started by depressing a copy button, the pick-up roller 14*a* or 14*b* and the conveying roller 15*a* or 15*b* start rotating to feed a sheet S (a transfer sheet in this embodiment) from the cassette 7*a* or 7*b*. The sheet S advances between the light emitting portion 75*a* and the light receiving portion 75*b* of the light sensor 75 and is once stopped by the registration roller couple 17 to be timed with the operation of the copying station 2. The sheet S, fed to the copying station 2 by the registration roller couple 17, receives a toner image in the copying station 2 and is then conveyed to the fixing device 20. At this time, the lateral position (perpendicular to the sheet conveying direction), for example, a deviation from a reference line L3n (n: order of the sheet) is detected by the boundary between the light receiving area and the non-receiving area by the light receiving portion 75*b*. The electrical signal corresponding to the detected lateral position of the sheet is transmitted to the microprocessor unit MPU for controlling the copying apparatus 1 and is stored in a memory thereof. In accordance with the lateral position detected, the microprocessor unit MPU prepares to shift the other registration roller couple 31 in its longitudinal direction.

Sooner or later, the pick-up roller 14*a* or 14*b* and the conveying roller 15*a* or 15*b* are stopped. The sheet S having been subjected to the image fixing operation by the fixing device 20 is going to be transported to the sheet conveying passage 19 by the operation of the flapper 23 or the like so as to receive an additional image for duplex or superimposing copy. However, if it is detected that the length of the sheet L (in the direction of sheet conveyance) is shorter than the minimum length Lmin, that is, the minimum length of a sheet capable of being conveyed by the sheet passage 19, the sheet S is discharged onto the external tray whether or not the operator selects the duplex or superimposing mode. The length of the sheet may be detected by the time period passing by the sensor 71 or by the sheet size peculiar to the selected cassette. If the sheet is detected as having the length larger than the minimum length Lmin, it is directed through the passage 27 and is received by the conveying roller couple 28. Then, the leading edge of the sheet S reaches the next conveying roller couple 29. The conveying roller couple 29 starts to rotate a predetermined period after the sheet S reaches there so that a curling or loop of the sheet is formed between the conveying roller couples 28 and 29, thus correcting oblique conveyance of the sheet. If the sheet length detected is equal to the minimum length Lmin, the solenoid 45 is energized simultaneously with the start of the rotation of the conveying roller couple 29 to place the conveying roller couple 30 in a press-contacted condition.

When the sheet S being refed by the conveying roller couples 28, 29 and 30, reaching the registration roller couple 31, it is detected by the sensor 73 immediately before the registration roller couple 31. In response thereto, the conveying roller couples 29 and 30 continue to convey the sheet S for a predetermined period of time after the leading edge of the sheet S abuts the nip between the upper roller 31*b* and the lower roller 31*a* which are not rotating at this time. After the predetermined period passes, the conveying roller couples 29 and 30 stop, whereby a proper amount of loop of the sheet is formed with the leading edge of the sheet being abutted to the nip between the upper roller 31*b* and the lower roller 31*a*. Then, the conveying roller couples 29 and 30 rotate forward, and simultaneously, the electromagnetic clutch 66 is energized, by which the rotation of the driving gear 61 is transmitted to the gear 65 through the shaft 69 and the gear 70 to start the lower roller 31*a* to rotate. Thus, the conveying action starts while maintaining the loop of the sheet gripped by the upper roller 31*b* and the lower roller 31*a*. Simultaneously, the spring clutch 59 is actuated to transmit the rotation of the driving gear 60 through the shaft 61 to the cam member 57 to rotate the cam member 57, by which the block 56 is shifted through the roller 56*b* from the start or home position in the direction B. If necessary or desired, it is once moved to the rightmost end and then is moved to the leftmost end in the direction A, and thereafter, it is moved again in B direction. In this manner, the sheet is moved in the lateral direction while it is being conveyed. During this operation, the loop is effective to allow smooth lateral movement of the sheet without imparting any significant force to the sheet or deforming it. During the lateral movement of the sheet S, the photosensor 71 checks the lateral position of the sheet S. When the lateral position of the sheet S becomes coincident with the lateral position (L31, L32, L33 . . . ) of the sheet which has been detected by the photosensor 7 and memorized in the microprocessor unit MPU at the time of the first side copy, the spring clutch 59 is disengaged by the instruction from the microprocessor unit MPU so that the lateral movement of the upper roller 31*b* and the lower roller 31*a* stops. The upper roller 31*b* and the lower roller 31*a* continue to rotate for a predetermined period to transport the sheet S through the sheet passage 19 to the registration roller couple 17 with its lateral position corrected. After the sheet is conveyed, the electromagnetic clutch 66 is disengaged to stop the rollers 31*b* and 31*a*, and the registration roller couple 31 is moved to the central home position by a resetting operation with the aid of the light blocking plate 62 and the photosensor 63 or the like, so that it is prepared for correcting the lateral position of the next sheet.

Continuous Duplex or Superimposing Copy for a Sheet having a Length Lmax

A first original is set on an original supporting platen, and a desired number N of copies is set by the copy number selector 120, and is transmitted to and stored in the microprocessor unit MPU. Then, the unshown copy button is depressed to instruct the copying operation. Similarly to the case of single copy described hereinbefore, the sheet having the length Lmax measured in the direction of sheet conveyance is fed out of the cassette 7*a* or 7*b* and is passed between the light emitting portion 75*a* and the light receiving portion 75*b* of the photosensor 75, during which the lateral position thereof is detected. After the sheet is subjected to the first image forming operations which are the same as described hereinbefore, the sheet reaches the conveying roller couple 28. The operations thereto are similar to the case of a single sheet in the duplex or superimposing mode. If the length of the sheet S is detected as being larger than the maximum length Lmax by, for example, the time period of the sheet passage by the photosensor 75, the copying apparatus 1 rejects the continuous duplex or superimposing copy operation and produces a warning to the operator. At the time when the sheet S reaches the conveying roller couple 28, the arm 28*c* is at an upper position (its right end) as shown in FIG. 1, and the conveying roller couples 29, 30 are at rest. When the sheet detecting sensor 32 detects the sheet S, the arm 28*c* rotates clockwise together with the sheet conveyance by the conveying roller couple 28. The conveying roller couple 29 starts the forward rotation in response to a command from the control means, a predetermined ($td_1$, FIG. 10) after the sheet detecting sensor 32 detects the sheet S, the predetermined period being so determined that the sheet S abuts at its leading edge the nip between the upper and lower rollers of the conveying roller couple 29 and is formed into a proper amount of loop so as to correct the oblique conveyance of the sheet. At this time, the conveying roller couple 30 rotates synchronously, but the upper roller 30*b* are at its retracted position so that the conveying roller couple 30 does not impart any driving action to the sheet S. After a predetermined period ($t_{11}$, FIG. 10) after the conveying roller couple 29 starts its forward rotation, more particularly, after the sheet S is advanced by an amount L1 which is so determined that the trailing edge of the sheet S is completely released from the conveying roller couple 28 and is disposed downstream of the swinging range of the arm 28*c*, the conveying roller couple 29 once stops, and simultaneously, the arm 28*c* rotates counterclockwisely (upward). Then, the conveying roller couple 29 rotates backwardly for a predetermined period of time ($t_{12}$, FIG. 10), so that the sheet S is reversed toward the upstream side by an amount L2 which is less than L1, whereby the trailing edge of the sheet S is introduced into the sheet turnout 50. The trailing edge of the sheet is possibly not completely received by the turnout portion 50 by curling or the like. This is obviated in the following manner.

Figure 7:
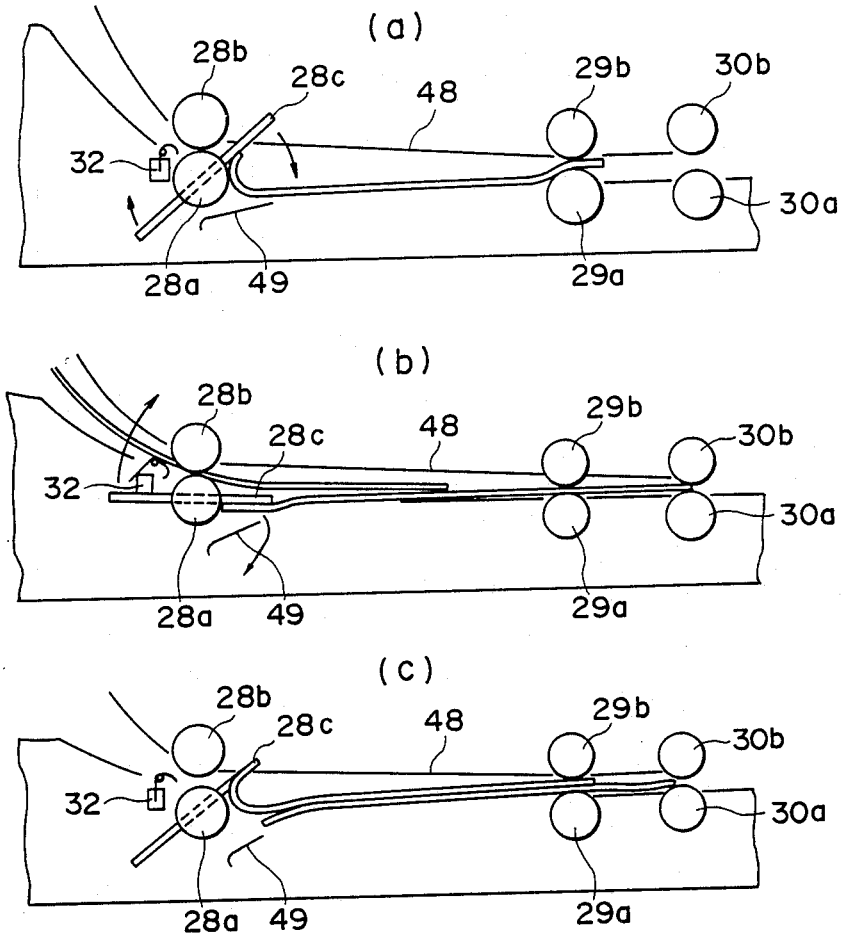
FIG. 7 and 8 are sectional views illustrating operations of the sheet feeding apparatus according to the first embodiment.

FIG. 7, (a) shows the sheet S in such a situation. Even if such a situation occurs, there is no problem. When the second sheet is subjected to the first side copying operation and is advanced through the conveying roller couple 28, the arm 28*c* rotates clockwisely (downward) similarly to the case of first sheet in response to the second sheet being detected by the sensor 32. By this rotation, the trailing edge portion of the first sheet is pushed toward the lower guiding plate 49, as shown in FIG. 7, (b), so that the second sheet is advanced above the first sheet with certainty.

Similarly to the first sheet, after the loop of the sheet is formed by the roller couple 29, the conveying roller couple 29 is rotated forward for the predetermined period $t_{11}$, whereby the sheet is advanced to the downstream side through a distance L1 together with the first sheet, then, they are reversed to the upstream side through the distance L2 by the conveying roller couple 29 reversely rotating for the predetermined period $t_{12}$ (FIG. 7), (c). This is repeated for the set number N. As a result, a bundle of N sheet is formed in the form of a stepwise stack with the length of the step being $\gamma = L1 - L2$. Here, the copying apparatus 1 once stops to allow the operator to replace the original on the original supporting platen 4. The operator depresses the copy button to form the second side image.

Figure 8:
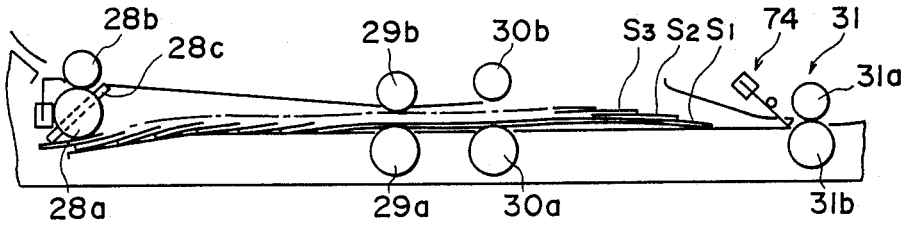
Figure 8:
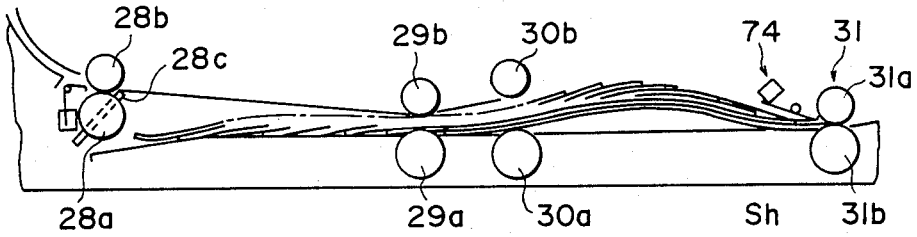
Figure 8:
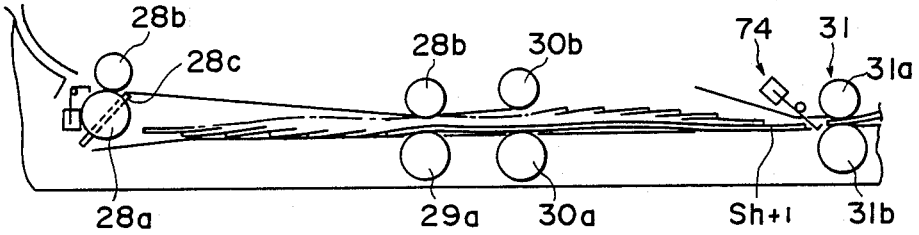

As shown in FIG. 8, (a), the conveying roller couple 29 starts the forward rotation to advance the bundle of N sheets as a whole. The conveying roller couple 29 stops after a predetermined period $t_{21}$ has passed after the leading edge of the first sheet S1 is detected by the sensor 74 adjacent the registration roller couple 31 downstream of the conveying roller couple 29, so as to advance the bundle through a predetermined length; more particularly, the conveying roller couple 29 stops after the trailing edge of the first sheet S1 becomes apart from the conveying roller couple 29 and before the second sheet S2 is sensed by the sensor 74. During the movement of the bundle, the upper roller 29*b* and the lower roller 29*a* of the conveying roller couple 29 are operatively coupled through the gear train, and therefore, even if the conveying roller couple repeats forward and backward rotations, the bundle is not broken but is moved in order. As shown in FIG. 8 (b), at the instance when the conveying roller couple 29 stops, a loop of the bundle is formed with the leading edge of the first sheet abuts the nip of the registration roller couple 31, while the second and subsequent sheets are gripped by the conveying roller couple 29. Next, the registration roller couple 31 starts to rotate while the conveying roller couple 29 being maintained unrotating, so that the first sheet S1 is fed out to the image forming station 2, as shown in FIG. 8, (c). During this operation, similarly to the case of the single sheet, the lateral position of the sheet is corrected. In the lateral correcting operation, N-1 sheets are placed on the trailing portion of the first sheet, but the total weight of the sheets are at most several tens grams, and therefore, they do not substantially obstruct the correcting operation by the registration roller couple 31. Then, the second and the subsequent sheets are fed out to the image forming station through the same operations as described. The produced duplex copies are discharged out of the copying apparatus.

Continuous Duplex or Superimposing Mode for Sheet having Length Lmin

Similarly to the previous case for the sheet Lmax, the sheets (Lmin) having been subjected to the first side image forming operation are conveyed by the conveying roller couple 28 to the conveying roller couples 29 and 30, while the arm 28*c* rotates clockwisely. When it is detected that the sheet has the minimum size Lmin, the solenoid 45 is energized to contact the two rollers 30*a* and 30*b* of the conveying roller couple 30, so that the conveying roller couple 30 is brought into operating states. A predetermined period after the sheet detecting sensor 32 detects the sheet, more particularly, after the leading edge of the sheet abuts the nip of the conveying roller couple 29 with a formation of a loop of the sheet so that the oblique conveyance of the sheet is corrected, the conveying roller couple 29 starts its forward rotation in response to a signal from the control means. After the trailing edge of the sheet S is completely released from the conveying roller couple 28, and the sheet S is advanced through such a distance L'1 that the trailing edge comes downstream of the swinging range of the arm 28*c*, the conveying roller couple 29 once stops, and then, is reversed to move the sheet S back toward upstream through a distance L'2 which is smaller than the distance L'1. By this operation, the trailing edge of the sheet is introduced into the sheet turnout 50 so that the second sheet is not inserted under the first sheet. Even if the trailing edge of the sheet is not received by the turnout portion 50 by, for example by curling of the sheet, the action of the arm 28*c* as described hereinbefore effectively prevents the second sheet from entering under the first sheet. After a predetermined period after the entrance of the second sheet is detected by the sheet detecting sensor 32, the conveying roller couple 29 rotates through a predetermined amount and stops, so that the sheet is advanced and stopped when the leading edge of the first sheet is away from the nip of the conveying roller couple 29 by the distance $\gamma$. The leading edge of the second sheet reaches the nip of the conveying roller couple 29 which is then at rest. The operation, the same as in the first sheet, is performed for the second sheet, and it is repeated for the set number of times N. As a result, a bundle of N sheets is formed on the sheet conveying passage 19 in the form of a stepwise stack with the length of step being $\gamma$. After the bundle of sheets is formed, the second side copying operation is started. The conveying roller couples 29 and 30 start their forward rotation to advance the bundle of N sheets. After the leading edge of the first sheet is detected by the sensor 74 adjacent the registration roller couple 31 downstream of the conveying roller couple 30, the sheet is further advanced through a predetermined distance, more particularly, after the trailing edge of the first sheet is completely released from the conveying roller couple 30 and before the second sheet is detected by the sensor 74, the conveying roller couples 29 and 30 are stopped. In this state, a loop of the first sheet is formed with its leading edge abutting the nip of the registration roller couple 31, while the second and subsequent sheets are gripped by the conveying roller couples 29 and 30. Then, the registration roller couple 31 starts to rotate, while the conveying roller couples 29 and 30 are being maintained at rest to refeed the first sheet back to the image forming station 2. During this refeeding operation, the lateral position of the first sheet is corrected in the similar manner as described in the single sheet operation.

In the similar manner, the second and subsequent sheets are continuously fed to the image forming station, and the resultant duplex copies are discharged out of the copying apparatus.

The sheets having a size between Lmin and Lmax can be dealt with in the same manner as in the case of Lmin sheet.

The conveying roller couples 28, 29 and 30 and the registration roller 31 may be controlled by clutching means employed and interposed between a driving source or sources and the respective rollers. Or, motors are operatively connected to the respective rollers, and the motors are controlled.

FIGS. 11A–11F are flow charts illustrating the above-described operation in the duplex or superimposing mode when two sheets are subjected to the image forming operation.

In this embodiment, the control of the rotational amount of the conveying roller couples 29, 30 and the registration roller couple 31 is performed using a timer in the microprocessor unit MPU. However, the control may be carried out by directly detecting the rotational angle of each of the roller couples and by controlling on the basis of the detection.

In the above-described embodiment, the reversible conveying means includes two conveying roller couples 29 and 30. However, the number of the conveying roller couples is not limiting and may be larger. Further, in this embodiment, the upper and lower rollers of the conveying roller couple are drivingly connected, but one of the rollers may be simply a follower roller, depending on the material of the sheet. Further, the rotational speed of the conveying roller couples may be independent from the sheet conveying speed in the copying machine and may be lower than that to make the sheet positioning more accurate.

The arm 28*c* is not absolutely necessary, although preferable, when the curling of the sheet is considered as occurring with little possibility. In this case, the sheet trailing edge is introduced into the turnout 50 only by the lowered and backward rotation of the conveying roller couple.

In this embodiment, when the first sheet of the bundle of the stepwisely stacked sheet by the registration roller couple 39, the second and subsequent sheets are gripped by the conveying roller couples 29 and 30 to prevent the double feed, but this is not limiting. For example, the bundle of the stepwisely stacked sheets are conveyed on a conveyor belt, and each time the then leading sheet is fed out by the roller couple, the then second and subsequent sheets may be pushed to a conveyor belt by a pushing member to prevent the double feed. Further alternatively, the remaining sheets may be gripped between the conveyor belt and an additional belt, when the then leading sheet is to be fed out.

Figure 12:
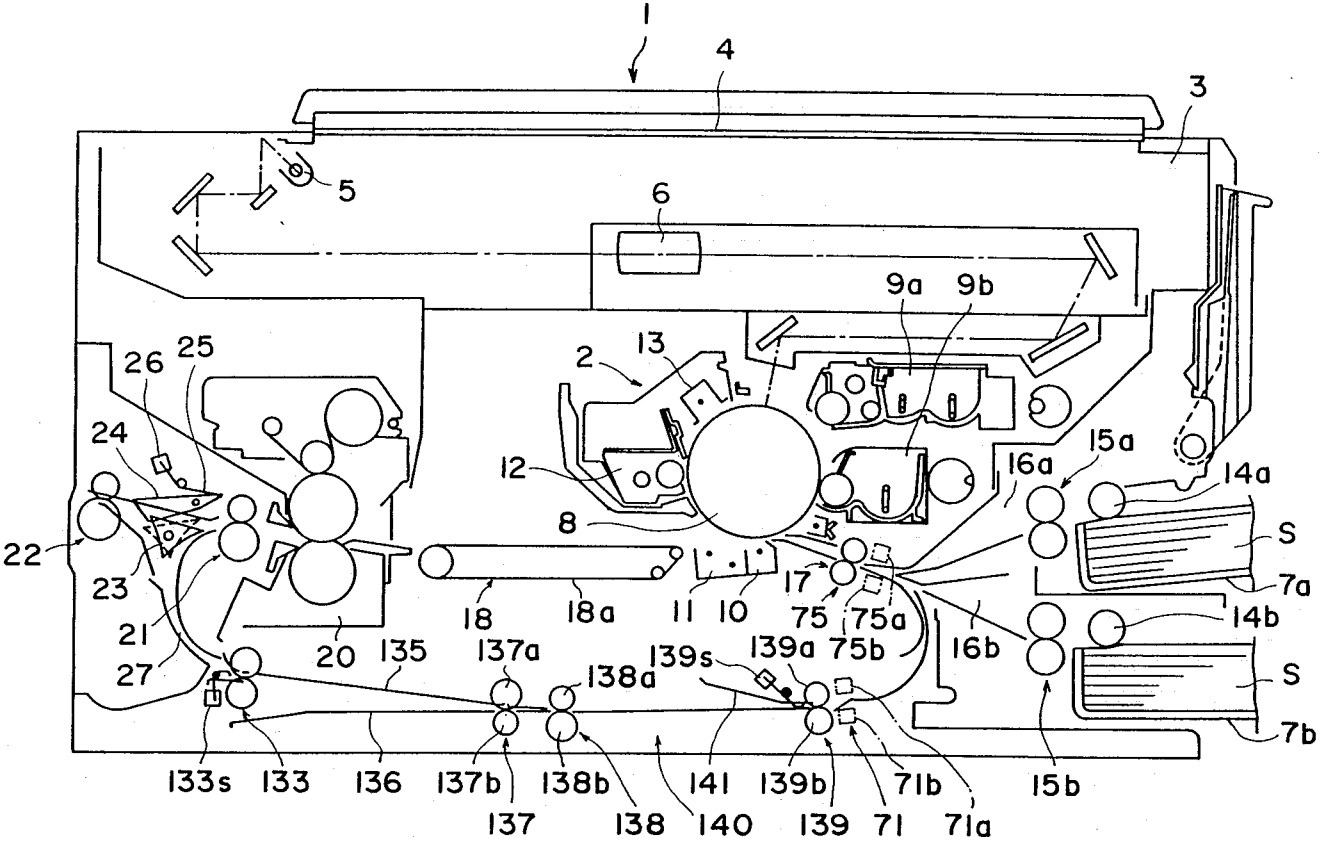
FIG. 12 is a sectional view of a general arrangement of an image apparatus incorporating a sheet conveying apparatus according to a second embodiment of the present invention.

FIG. 12 illustrates a second embodiment. Since this embodiment is similar to the foregoing, except for the portions which will be described, the detailed description is omitted for the sake of simplicity by assigning the same reference numerals to the elements having corresponding functions.

Figure 22:
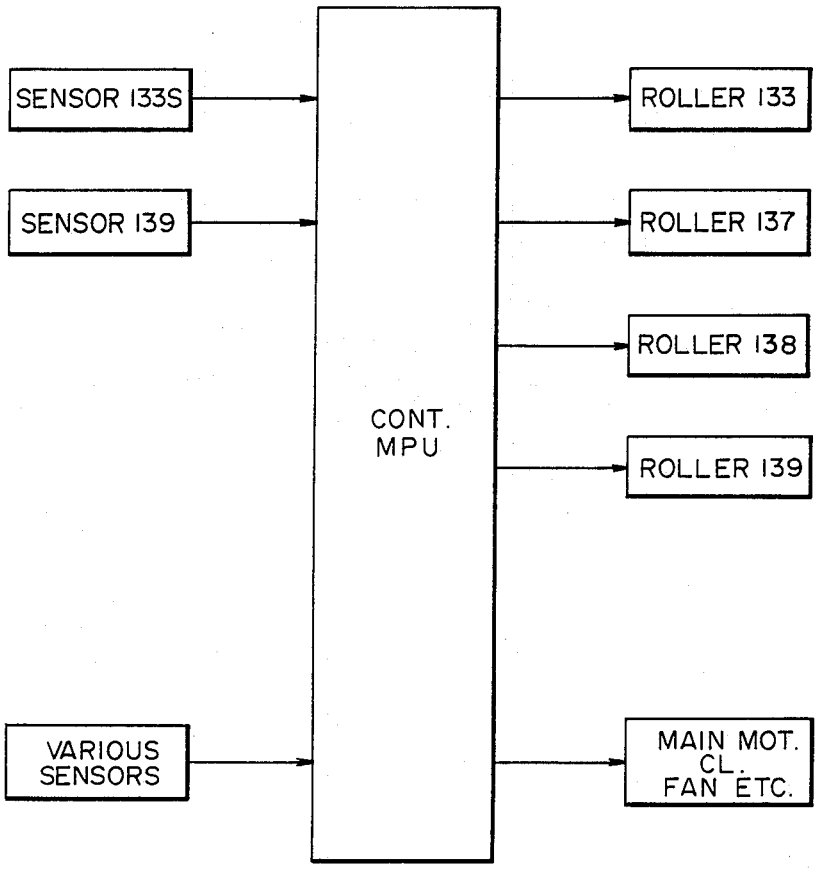
FIG. 22 is a block diagram illustrating a control system sheet conveying apparatus according to the second embodiment.
Figure 23:
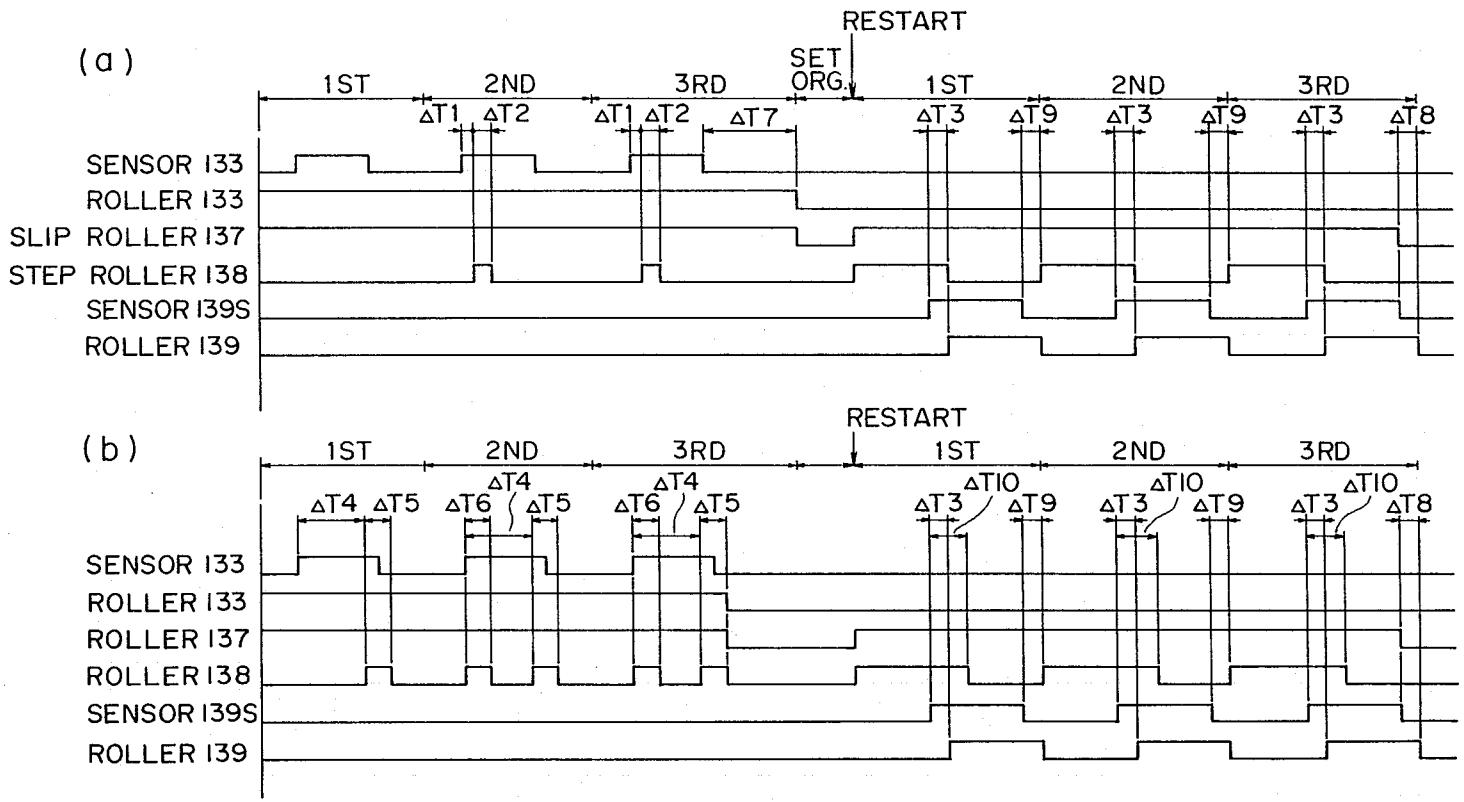
FIGS. 23A and 23B are time charts illustrating the operation of the second embodiment.
Figure 24A:
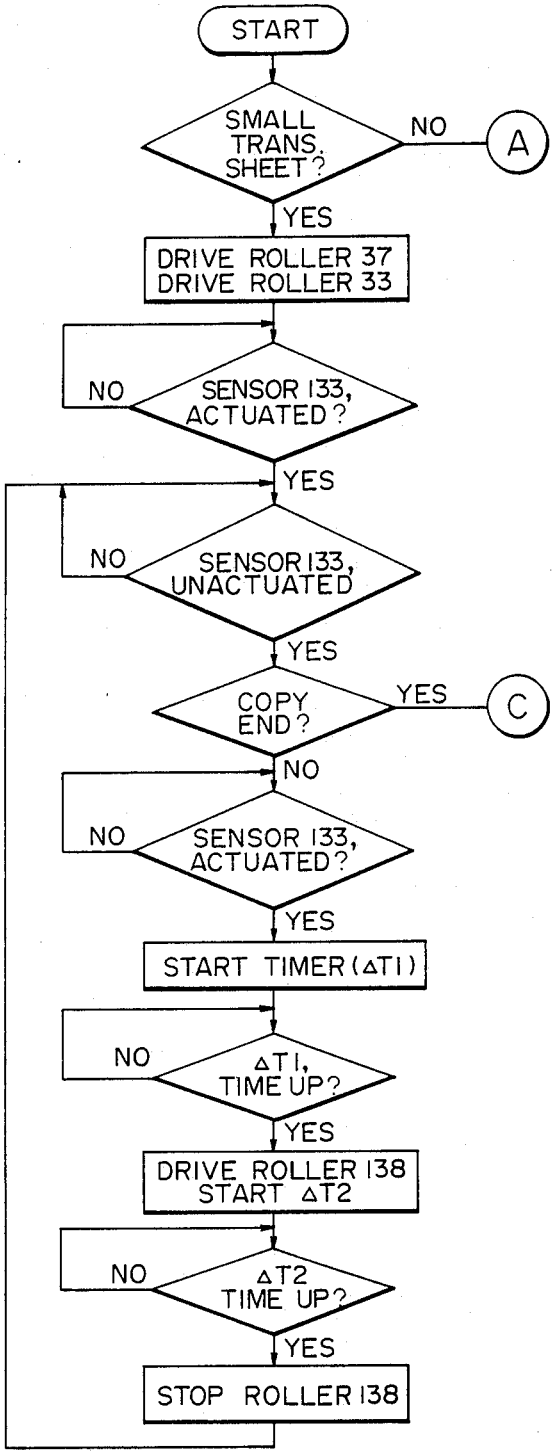
FIGS. 24A–24E are flow charts illustrating operations of the sheet conveying apparatus according to the second embodiment.
Figure 24B:
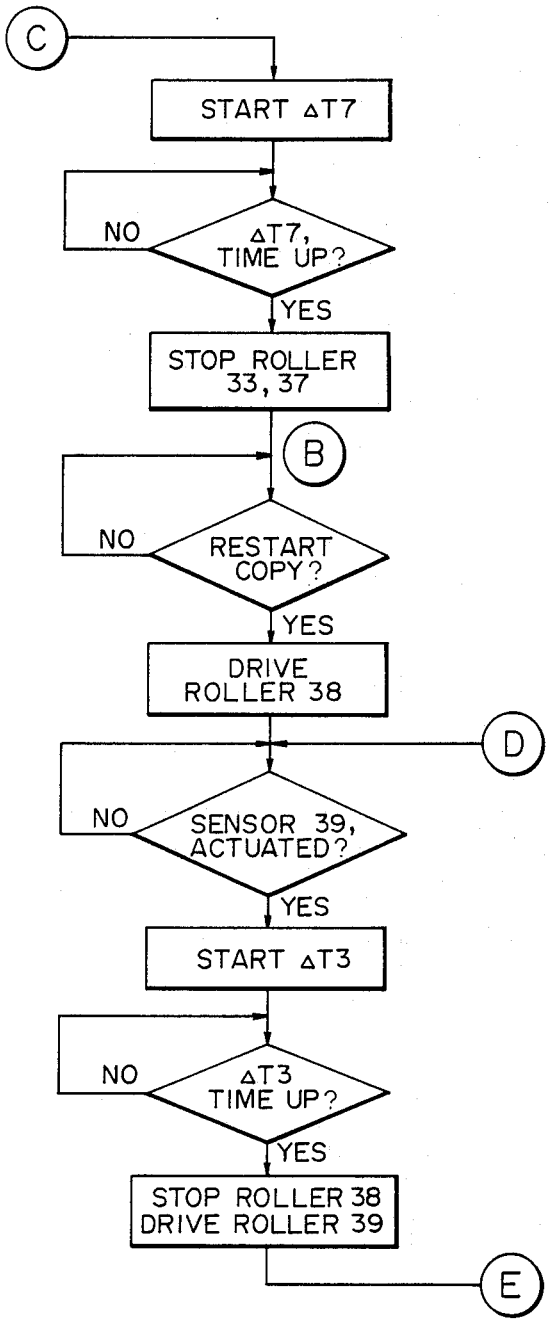
Figure 24C:
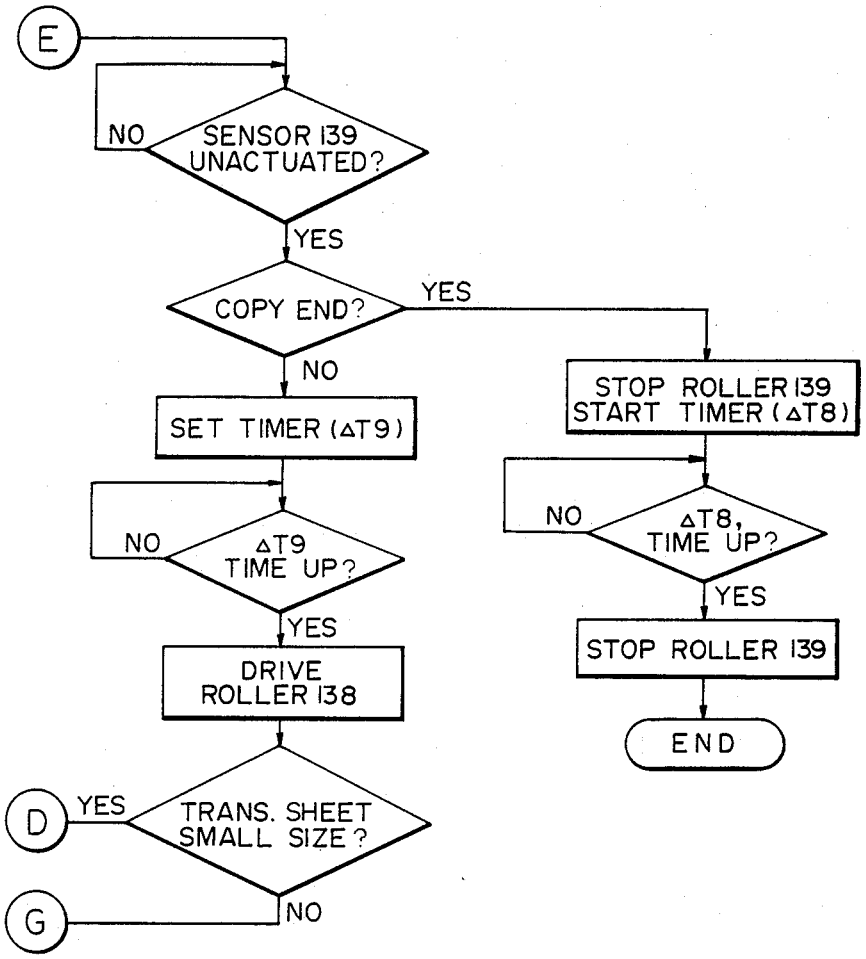
Figure 24D:
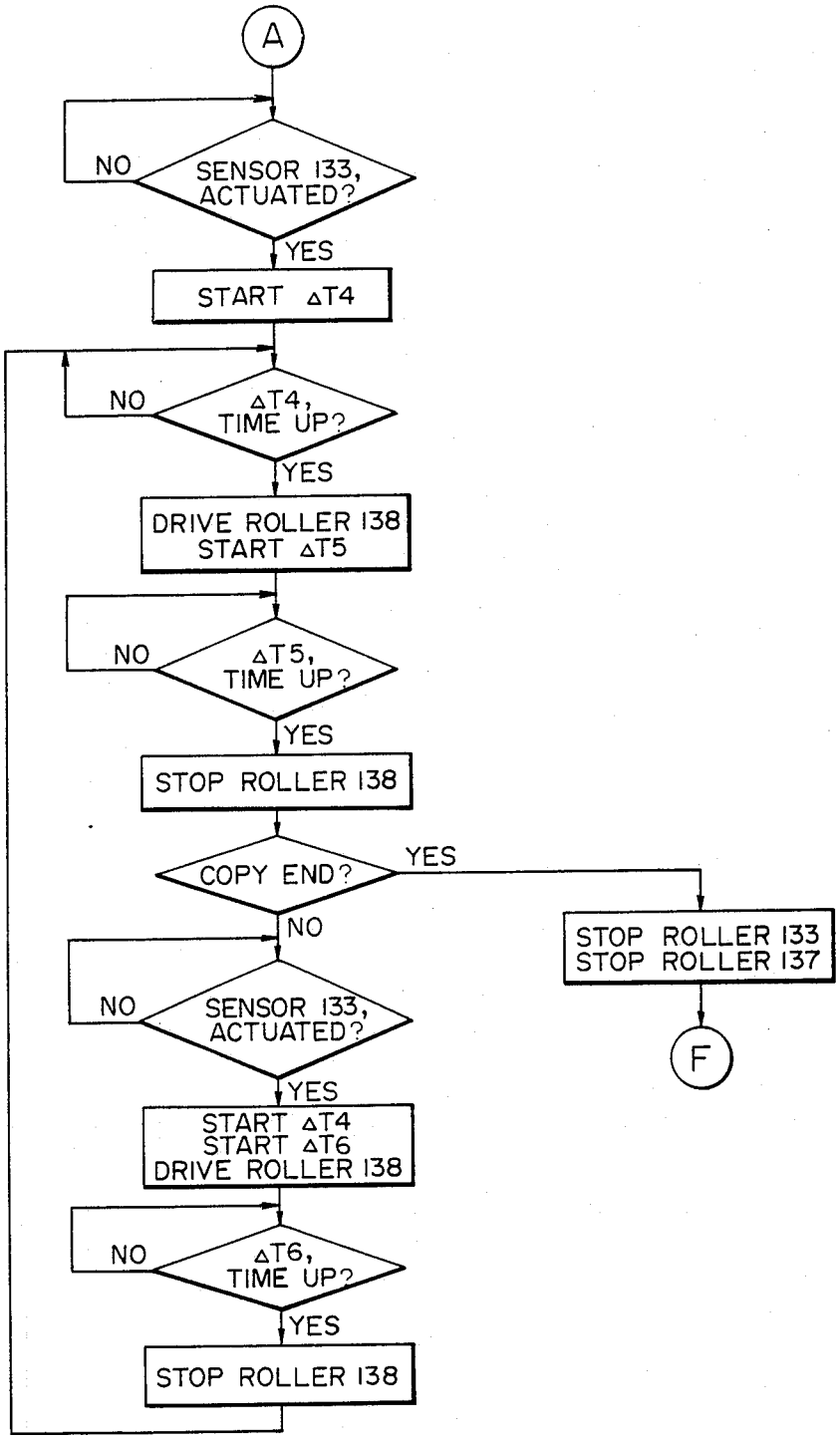
Figure 24E:
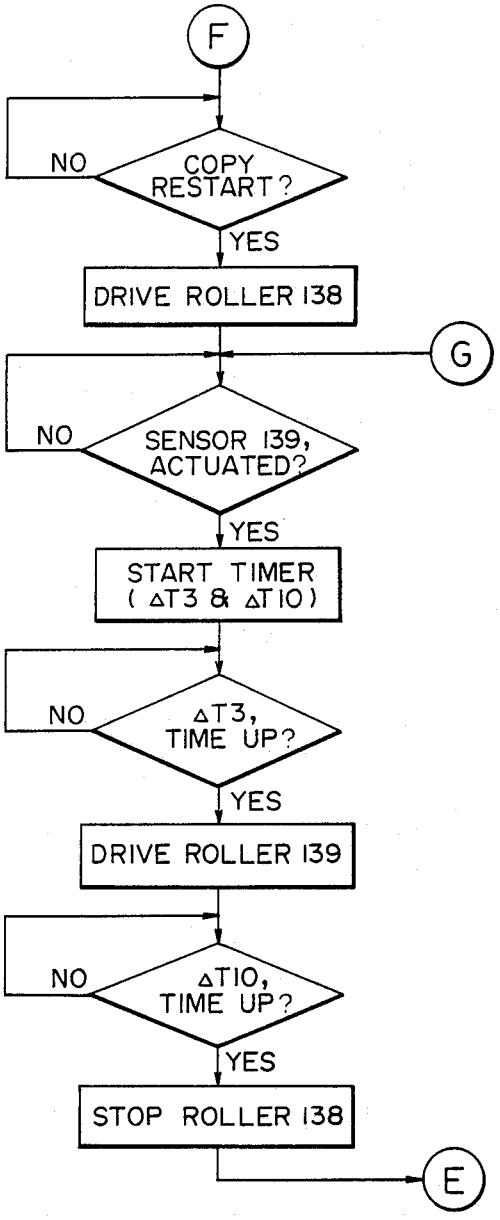

FIG. 22 is a control block diagram for the second embodiment, wherein the portions common to the first embodiment are omitted.

In this embodiment, downstream of the sheet passage 27 are disposed an inlet sensor 133*S*, a conveying roller couple 133, conveying guide plates 135, 136, a slip roller couple 137, a step roller couple 138 and a lateral registration roller couple 139, which constitute a refeeding station 140. The lateral registration roller couple 139 includes an upper roller 139*a* and the lower roller 139*b*, and at the upstream side thereof, an inlet guide 141 and an inlet sensor 139*s* are disposed. At the downstream side, there is disposed a photosensor 71 including a light emitting portion 71*a* and an associated light receiving portion b. A distance between the conveying roller couple 133 and the slip roller couple 133 is shorter than the length of the sheet S; a distance between the roller couple 133 and the step roller couple 138 is longer than the sheet S length; and a distance between the roller couple 138 and the lateral registration roller couple 139 is slightly shorter than the sheet S length.

Figure 13:
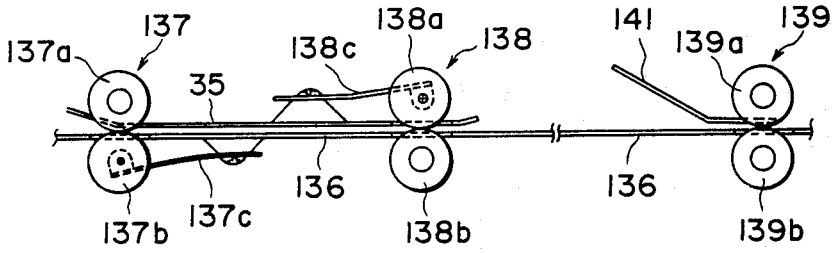
FIG. 13 is a side view of a sheet conveying apparatus.
Figure 14:
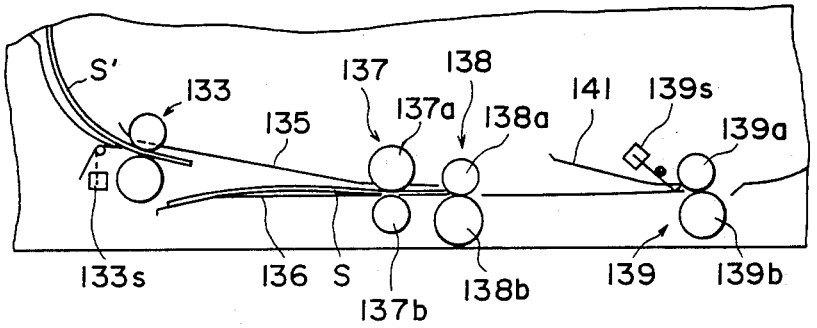
FIGS. 14–21 are sectional views of the sheet conveying apparatus illustrating operations of the sheet conveying apparatus according to the second embodiment.

As shown in FIG. 13, the slip roller couple 137 includes a driving roller 137*a* and a pressing roller 137*b*. The driving roller 137*a* are rotatably supported between front and rear frames of the apparatus. The pressing roller 137*b* is rotatably supported on a leaf spring 137*c*, at an end thereof, having the other end fixed to the conveying guide 136, so that the pressing roller 137 is upwardly urged to be in contact with the driving roller 137*a*. The step roller couple 138 includes a confining roller 138*a* and a driving roller 138*b* which is connected to an unshown clutch and which is rotatably supported between the front frame and the rear frame. Further, the confining roller 138*a* is rotatably supported at an end of a leaf spring 138*c* having the other end fixed to the conveying guide 137, so that the confining roller 138*a* is in contact with the driving roller 138*b*. The conveying guides 135 and 136 are disposed adjacent to each other, and the guide 135 is pivotable about a pivot disposed at a rear side so as to allow jam clearance.

Referring to FIGS. 24A–24E and FIG. 23, the operation of the apparatus according to the second embodiment will be described.

Duplex or Superimposing Copy for One Sheet

The sheet S now having an image on one side is refed to the sheet conveying station 140 by the flapper 23 or the like.

When the sheet S reaching the registration roller couple 139, it is detected by the sensor 73. In response thereto, the step roller couple 138 continues to convey the sheet S for a predetermined period of time after the leading edge of the sheet S abuts the nip between the upper roller 139*a* and the lower roller 139*b* which are not rotating at this time. After the predetermined period passes, the step roller couple 138 stops, whereby a proper amount of loop of the sheet is formed with the leading edge of the sheet being abutted to the nip between the upper roller 139*a* and the lower roller 139*b*. Then, the step roller couple 138 rotates, and simultaneously, the lower roller 139*b* starts to rotate. Thus, the conveying action starts while maintaining the loop of the sheet gripped by the upper roller 139*a* and the lower roller 139*b*. Simultaneously, the upper and lower rollers 139*a* and 139*b* are shifted, if necessary, from the start or home position toward a rear or front side. During this operation, the loop is effective to allow smooth lateral movement of the sheet without imparting any significant force to the sheet or deforming it. During the lateral movement of the sheet S, the photosensor 71 checks the lateral position of the sheet S. When the lateral position of the sheet S becomes coincident with the lateral position of the sheet which has been detected by the photosensor 7 and memorized in the microprocessor unit MPU at the time of the first side copy, the microprocessor unit MPU stops the lateral movement of the upper roller 139*a* and the lower roller 139*b*. The upper roller 139*a* and the lower roller 139*b* continue to rotate for a predetermined period to transport the sheet S through the sheet passage 140 to the registration roller couple 17 with its lateral position corrected. After the sheet is conveyed, the rollers 139*a* and 139*b* and stopped, and the lateral position correcting means 139 is moved to the central home position by a resetting operation, so that it is prepared for correcting the lateral position of the next sheet.

Superimposing Mode for Plural Sheets from same Originals

[The length of the sheets are longer than the distance between the conveying roller couple 133 and the slip roller couple 137 and is shorter than the distance between the conveying roller couple 133 and the step roller couple 138 (smaller size sheets).]

FIG. 23, (a)

Figure 15:
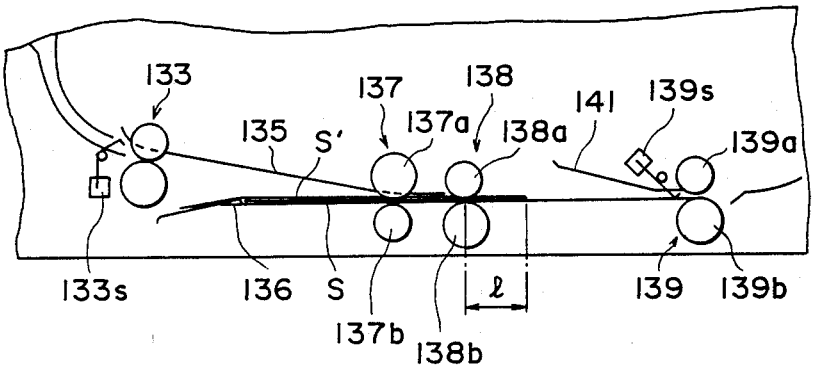

When the first sheet having been subjected to the first copying operation is introduced into the passage 27, it is gripped and conveyed by the conveying roller couple 133 and is passed by the inlet sensor 133*s*. It advances between the conveying guides 135 and 136 to the slip roller couple 137 which is rotating during the copying apparatus 1 being in operation. The microprocessor unit has stored the size of the sheet in accordance with an unshown sheet size detecting means provided on the cassette. By the slip roller couple 137, the sheet S is gripped and conveyed to the step roller couple 138. However, at this time the step roller couple 138 is at rest. Since the slip roller couple 137 has only a small gripping force provided by the pressing roller 137*b*, then when the sheet S abuts the nip between the confining roller 138*a* and the driving roller 138*b* of the step roller couple 138, the oblique conveyance of the sheet is corrected. When the second sheet S′ is introduced so that it is detected by the inlet sensor 133*s*, the step roller couple 138 is driven after a predetermined period of time $\Delta T1$ after the detection by the inlet sensor 133*f*, more particularly, at the time when the leading 1 of the second transfer sheet S′ advances beyond the trailing edge of the first sheet S. The step roller couple 138 continues to rotate for a predetermined period of time $\Delta T2$ (FIG. 23A) so as to advance the sheet S through a distance l (FIG. 15). The sheet S′ is conveyed by the conveying roller couple 133 and the slip roller couple 137 and is stopped by the step roller couple 138 (FIG. 15). In this manner, a bundle of sheets of which the leading edges are stepwisely deviated is formed and is gripped by the slip roller couple 137 and the step roller couple 138. The number selected by the copy number selector means, of the copies are produced, the conveying roller couple and the slip roller couple 137 are stopped after a predetermined period $\Delta T7$ elapses. The operator replaces the original and depresses a copy button. In response thereto, the microprocessor unit MPU starts the slip roller couple 137 and the step roller couple 138 to rotate, thus advancing the bundle of the transfer sheets to the lateral registration roller couple 139 which is then at rest. When the leading edge of the bundle of the sheets, that is, the leading edge of the sheet S, is brought into contact with the inlet sensor 139*s* upstream of the lateral registration roller couple 139, the step roller couple 138 is stopped after a predetermined period ΔT3 elapses, by the instructions from the microprocessor unit MPU.

Figure 16:
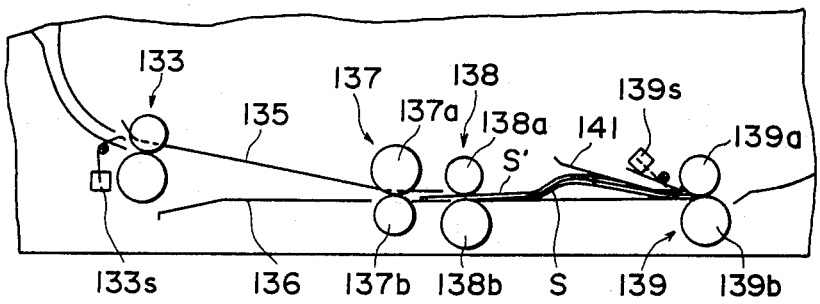
Figure 17:
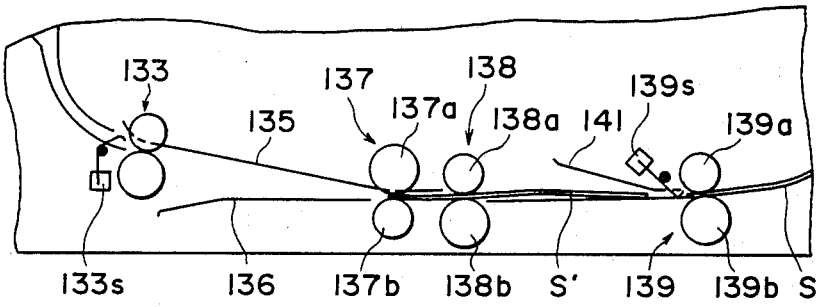
Figure 18:
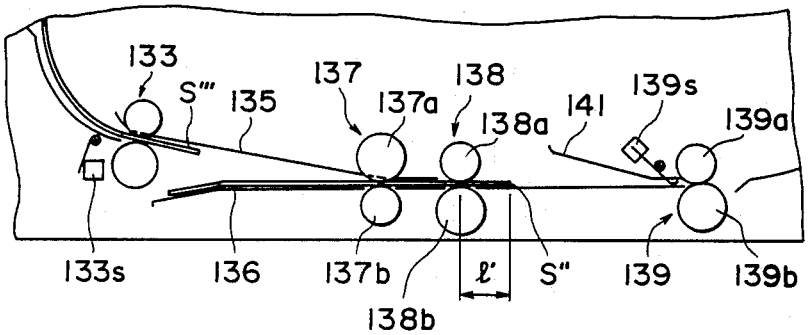

As shown in FIG. 16, the sheet S at this time is conveyed through the step roller couple 138 and is abutted to the nip of the lateral registration roller couple 139 with formation of a loop thereof. The sheet S' is still gripped by the step roller couple 138. The loop of the sheet S provides force for the sheet to enter into the nip of the lateral registration roller couple 139. After a predetermined period ΔT5, the registration roller couple 139 is driven by the microprocessor unit MPU, by which the sheet S is refed back to the first registration roller couple 17, during which the sheet S gripped and conveyed by the lateral registration roller couple 139 is corrected in its lateral position (FIG. 17). The correction of the lateral position by the roller couple 139 is the same as in the first embodiment. During the lateral correcting operation, the sheet S' is on the sheet S, and only the weight of the sheet S' is applied to the sheet S, and therefore, it does not obstruct the lateral correcting operation. Also, the sheet S' is gripped by the step roller couple 138, and therefore, even if there exists an electrostatic attracting force or the like between the sheet S and sheet S', no double feed occurs. The sheet S is supplied into the copying station 2 by the registration roller couple 17 and is subjected to the superimposing copy operation, and then transported into the image fixing device 20 by the conveying device 18, and thereafter is discharged out of the copying apparatus 1 by the discharging roller couples 21 and 22.

After a predetermined period of time ΔT9 after the first sheet S passes by the sensor 139s, the roller couple 138 is rotated to advance the second sheet S' to the roller couple 139. Subsequently, the same operation as for the first sheet S is repeated to refeed the sheet S' to the registration roller couple 17. The same operation is repeated for the third and fourth and subsequent sheets, if any.

When the number, preset by the copy number selector means, of the copies are produced, the roller couple 139 is stopped a predetermined period T8 after that.

[The sheet size is longer than the distance between the step roller couple 138 and the lateral registration roller couple 139 detected by the size detecting means and the microprocessor unit MPU]

FIG. 23 (b)

Figure 19:
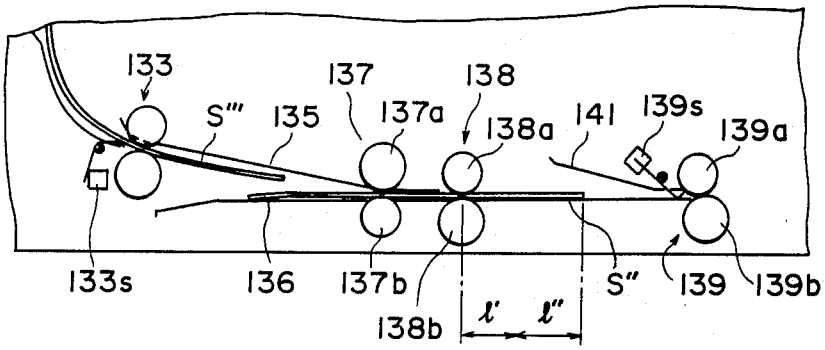

When the first sheet S'' having been subjected to the first side image forming operation is introduced into the sheet passage 27, the sheet S'' is advanced to the slip roller couple 137 by the conveying roller couple 133, and further to the step roller couple 138. Since the gripping force by the slip roller couple 137 is not strong, and also since the step roller couple 138 is not rotating, the sheet S'' abuts the nip formed between the confining roller 138a and the driving roller 138b so that the oblique conveyance of the sheet is corrected, and then the sheet is stopped. After a predetermined period of time ΔT4, the step roller couple 138 starts to rotate in accordance with instructions from the microprocessor unit MPU and continues to rotate for a predetermined period of time ΔT5, more particularly, until the trailing edge of the sheet S'' is released from the conveying roller couple 133. At this time, the microprocessor unit MPU stops the roller couple 138 at the instance when the leading edge of the sheet S'' is moved by the step roller couple 138 through a distance l'. When the next sheet S''' is introduced so that the inlet sensor 133s is actuated, the step roller couple 138 starts to rotate and continues for a predetermined period ΔT6 to advance the sheet S'' through a distance l'' (FIG. 19).

Figure 20:
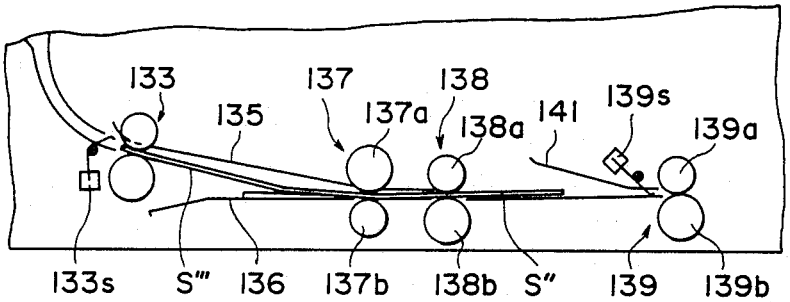
Figure 21:
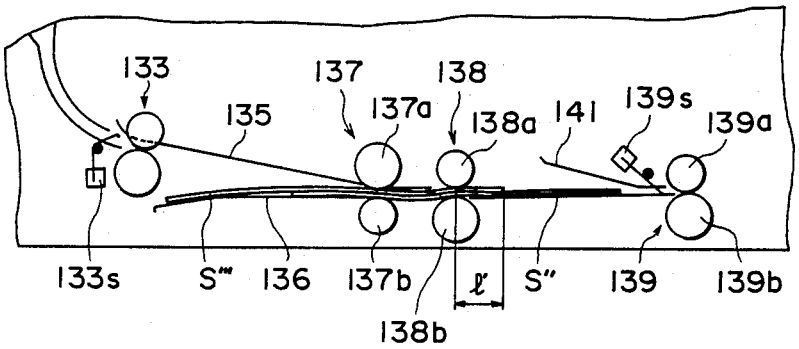

As shown in FIGS. 20 and 21, the transfer sheet S''' is abutted to the nip between the confining roller 138a and the driving roller 138b (ΔT4 from the actuation of the inlet sensor 133s). Thereafter, the roller couple 138 starts to rotate and continues for a predetermined period ΔT5 to advance the sheet S'''. through a distance l', so that the trailing edge of the sheet S''' is released from the conveying roller couple 133, in accordance with the instructions from the microprocessor unit MPU. When the preset number of copies are produced, the microprocessor unit MPU instructs the conveying roller couple 133 and the slip roller couple 137 to stop. In this manner, a bundle of sheets of which the leading edges are gradually deviated, is formed. Then, the operator replaces the original and depresses a copy button to produce superimposed copies. In response thereto, the microprocessor unit MPU instructs the slip roller couple 137 and the step roller couple 138 to start to rotate to advance the bundle of the sheets as a whole. The leading edge of the bundle, more particularly, the leading edge of the sheet S' actuates the inlet sensor 139s. After a predetermined period ΔT3 elapses therefrom, more particularly, when the leading edge portion of the sheet S'' is abutted to the nip of the lateral registration roller couple 139 to form a proper amount of loop, the lateral registration roller couple 139 starts to rotate in accordance with the instruction from the microprocessor unit MPU. After a predetermined period ΔT10 elapses from the start of the step roller couple 138 rotation, more particularly, when the trailing edge of the sheet S'' is released from the step roller couple 138, the microprocessor unit instructs the step roller 138 to stop, and the lateral registration roller couple 139 corrects the lateral position of the sheet S'' and feeds the sheet to the first registration roller couple 17.

When the sheet passes by the sensor 139s, the step roller couple 138 is rotated again after a predetermined period ΔT9 therefrom, so as to advance the next sheet S''' to the lateral registration roller couple 139. The sheet S''' is fed to the lateral registration roller couple 17 in the same manner as for the sheet S''. When the number, preset by the copy number selector means, of the sheets are all passed by the sensor 139s, the slip roller couple 137 is stopped. After a predetermined period ΔT8 elapses, the lateral registration roller 139 is also stopped, thus terminating the operation.

Each or some of the rollers among the conveying roller couple 133, the slip roller couple 139, the step roller couple 138 and the lateral registration roller couple may be controlled through clutch means. Alternatively, each or some of the roller couples may be directly connected to a motor or motors which are controlled to control the roller rotation.

In the foregoing embodiment, the control of the roller rotations are effected using a timer in the microprocessor unit MPU, but may be effected on the basis of an angular position of the roller detected.

While the invention has been described with reference to the structures disclosed herein, it is not confined to the details set forth and this application is intended to cover such modifications or changes as may come within the purposes of the improvements or the scope of the following claims.

What is claimed is:

1. A sheet conveying apparatus, comprising:

conveying means for accommodating a bundle of sheets in a form in which leading edges of the sheets are gradually deviated in a sheet advancement direction, and for conveying the bundle as a whole;

feeding means, disposed downstream of said conveying means with respect to the sheet advancement direction, for feeding one by one the sheets of the bundle from the sheet closest to said feeding means; and confining means for confining the sheets of the bundle other than the sheet being fed by said feeding means, said confining means including first and second members for gripping and stopping the bundle of the sheet by contacting respective sides of the bundle.

2. An apparatus according to claim 1, wherein said conveying means includes a couple of rollers for gripping and moving the sheets therebetween.

3. An apparatus according to claim 1, wherein said conveying means includes a couple of rollers for gripping and conveying the sheets therebetween, which also function as said confining means by gripping the bundle of the sheets by contacting the respective sides of the bundle.

4. An apparatus according to claim 3, wherein the sheet closest to said feeding means is released from said confining means by conveying the bundle of sheets through a predetermined distance by said couple of rollers.

5. An apparatus according to claim 1, wherein said confining means confines the bundle at different positions in accordance with sizes of the sheets.

6. An apparatus according to claim 1, wherein said feeding means is effective to shift the sheet being fed thereby in a direction perpendicular to the sheet advancement direction.

7. A sheet conveying apparatus, comprising:

first conveying means for accommodating a bundle of the sheets in a form in which leading edges of the sheets are gradually deviated in a sheet advancement direction, and for conveying the bundle as a whole;

second conveying means, disposed upstream of said first conveying means with respect to a sheet advancement direction, for conveying the sheets to said first sheet conveying means;

control means for controlling said first conveying means to advance the sheet conveyed from said second conveying means through a first predetermined distance and then to reverse the sheet through a second predetermined distance which is shorter than said first predetermined distance so as to provide the gradual deviation whose distance is a difference between the first and second distances; and sheet guiding means including a guiding member for guiding a trailing edge portion of the sheet, said sheet guiding means guiding the sheet during the reversing of the sheet by said first conveying means so as to prevent the sheet from contacting said second feeding means.

8. An apparatus according to claim 7, wherein said sheet guiding means guides a trailing edge portion of the sheet to under said second conveying means.

9. An apparatus according to claim 7, wherein said guiding means is movable.

10. A method of conveying sheets, comprising:

conveying a sheet conveyed first conveying means by second conveying means in a predetermined direction;

conveying, while the sheet is being acted on by the second conveying means after a trailing edge of the sheet passes through the first conveying means, the sheet in a direction opposite to the predetermined direction by the second conveying means;

stopping the second conveying means when an edge of the sheet opposite to the trailing edge reaches a predetermined position which is away from the second conveying means by a predetermined distance toward downstream with respect to the predetermined direction;

repeating said conveying and stopping steps each time the sheet is conveyed by the first conveying means to the second conveying means, by which plural sheets are held by the second conveying means with the opposite edges thereof being displaced from adjacent ones by the predetermined distance.

11. A method according to claim 10, wherein the second conveying means is away from the first conveying means by a distance shorter than a length of the sheet measured along its conveyance direction.

12. A method according to claim 10, wherein the sheet conveyed by the first conveying means is conveyed by the second conveying means in the predetermined direction through a second predetermined distance shorter than a length of the sheet measured along its conveyance direction.

13. A method according to claim 12, wherein after the second conveying means conveys the sheet through the second predetermined distance, the second conveying means conveys the sheet in the opposite direction through a distance which is shorter than the second predetermined distance and then stops the sheet.

14. A sheet conveying apparatus, comprising:

first conveying means for conveying a sheet in a predetermined direction;

second conveying means for receiving the sheet conveyed by said first conveying means and for further conveying the sheet;

detecting means for detecting passage of a trailing edge of the sheet being conveyed in the predetermined direction through said first conveying means; and control means for controlling said second conveying means to convey the sheet in the predetermined direction; to stop the sheet, after said detecting means detects the passage of the trailing edge, when and edge of the sheet opposite to the trailing edge reaches a position which is away from said second conveying means by a first predetermined distance toward downstream with respect to the predetermined direction; to convey the sheet in the direction opposite to the predetermined direction; and to stop the sheet when the opposite edge of the sheet reaches a position which is away from said second conveying means by a second predetermined distance toward downstream with respect to the predetermined direction.

15. An apparatus according to claim 14, wherein the first predetermined distance is longer than the second predetermined distance.

16. An apparatus according to claim 14, wherein said control means further controls said second conveying means to stop the opposite edge of the sheet being conveyed by said first conveying means until a predetermined amount of a loop is formed, and then to start the conveyance in the predetermined direction.

17. An apparatus according to claim 16, wherein said second conveying means is away from said first conveying means by a distance shorter than a length of the sheet measured along its conveyance direction.

18. An apparatus according to claim 14, wherein said first conveying means includes a pair of rotatable members.

19. An apparatus according to claim 18, wherein said second conveying means includes a pair of rotatable members.

20. An apparatus according to claim 14, wherein said control means controls said second conveying means to repeat the operations of said second conveying means each time the sheet is conveyed thereto, to stack the sheets with the opposite edges thereof being displaced from adjacent ones by the second predetermined distance.

21. A method of conveying sheets, comprising:

abutting a leading edge of a sheet being conveyed by first conveying means to a second conveying means to form a loop;

operating the second conveying means, after the loop is formed, to convey the sheet by the second conveying means;

stopping the second conveying means when the leading edge of the sheet reaches a position which is away from the second conveying means by a predetermined distance toward downstream; and repeating said abutting, operating and stopping steps each time an additional sheet is conveyed by the first conveying means so that plural sheets are held by said second conveying means with the leading edges thereof being displaced from adjacent ones by the predetermined distance.

22. A method according to claim 21, wherein the loop of the sheet is formed on the preceding sheet held by the second conveying means.

23. A sheet conveying apparatus, comprising:

first conveying means for conveying a sheet in a predetermined direction;

second conveying means for receiving the sheet from said first conveying means and for further conveying it;

detecting means for detecting passage of the sheet at a predetermined position;

control means for controlling said second conveying means to operate said second conveying means to convey the sheet in the predetermined direction, on the basis of the detection by said detecting means, after a loop of the sheet is formed by a leading edge of the sheet being conveyed by said first conveying means being abutted to said second conveying means, and for controlling the second conveying means to stop said second conveying means when the leading edge of the sheet reaches a position which is away from said second conveying means by a predetermined distance toward downstream with respect to the predetermined direction.

24. An apparatus according to claim 23, further comprising guiding means for guiding the sheet to pass on the preceding sheet held by said second conveying means.

25. An apparatus according to claim 24, wherein the loop of the sheet is formed on the preceding sheet held by the second conveying means.

26. An apparatus according to claim 25, wherein said control means controls said second conveying means to repeat formation of the loop and subsequent conveyance of the sheet by the second conveying means each time the sheet is conveyed thereto from said first conveying means to hold the sheets by said second conveying means with the leading edges thereof being displaced from an adjacent one by the second predetermined distance.

27. An apparatus according to claim 23, wherein said first conveying means includes a pair of rotatable member.

28. An apparatus according to claim 27, wherein said second conveying means includes a pair of rotatable members.

29. A method of conveying sheets, comprising:

conveying a sheet conveyed by first conveying means by second conveying means in a predetermined direction;

stopping the second conveying means, while the sheet is being acted on by the second conveying means after a trailing edge of the sheet passes through the first conveying means;

conveying the sheet in the predetermined direction by the second conveying means after a leading edge of the sheet overtakes at trailing edge of a preceding sheet; and stopping the second conveying means while the current sheet and the preceding sheet are in said second conveying means.

30. A method according to claim 29, wherein said second conveying means is stopped after it receives the second sheet and when the leading edge of the first sheet reaches a position which is away from said second conveying means by a predetermined distance toward downstream with respect to the predetermined direction.

31. A method according to claim 29, wherein said second conveying means is stopped after a trailing edge of the first sheet passes through the first conveying means and when the leading edge of the second sheet reaches a position which is away from said second conveying means by a first predetermined distance toward downstream with respect to the predetermined direction.

32. A method according to claim 31, wherein said second conveying means is stopped after said second conveying means receives the second sheet and when the leading edge of the first sheet reaches a position which is away from said second conveying means by a second predetermined distance toward downstream with respect to the predetermined direction.

33. A sheet conveying apparatus, comprising:

first conveying means for conveying a sheet in a predetermined direction;

second conveying means for receiving and further conveying the sheet from said first conveying means;

trailing edge detecting means for detecting passage of a trailing edge of the sheet, which is being conveyed in the predetermined direction, through said first conveying means;

leading edge detecting means for detecting that a leading edge of the sheet, which is being conveyed in the predetermined direction, has reached a predetermined position; and control means for controlling said second conveying means to stop said second conveying means on the basis of detection by said trailing edge detecting means and to start said second conveying means to convey the sheet in the predetermined direction on the basis of detection by said leading edge detecting means.

34. An apparatus according to claim 33, wherein said control means stops said second conveying means on the basis of the detection by said trailing edge detecting means to stop the leading edge of the sheet at a first position, while said second conveying means holds the sheet.

35. An apparatus according to claim 34, wherein said control means controls said second conveying means to start said second conveying means, while a leading edge of a preceding sheet is at the first position and after the leading edge of the current sheet overtakes a trailing edge of the preceding sheet.

36. A method of conveying sheets, comprising:

conveying a first sheet conveyed by first conveying means by second conveying means in a predetermined direction;

stopping the second conveying means, while the first sheet is being acted on by the second conveying means after a trailing edge of the first sheet passes through the first conveying means;

further conveying the first sheet in the predetermined direction by the second conveying means after a leading edge of a second sheet overtakes a trailing edge of the first sheet; and stopping the second conveying means while the first sheet and the second sheet are being acted on by said second conveying means.

37. A method of conveying a sheet, comprising:

providing sheets which are stacked and deviated stepwisely by a predetermined distance in a predetermined conveying direction;

conveying the stack of sheets to sheet feeding means by conveying means;

stopping said conveying means after a leading edge of a sheet of the stack disposed at a most downstream position with respect to the conveying direction is abutted to said feeding means to form a loop of the sheet and after a trailing edge of the most downstream sheet passes through the conveying means; and then starting said feeding means, while the remaining sheets are held by the conveying means which has been stopped.

38. A method according to claim 37, wherein the start of the feeding means is effected after said conveying means stops.

39. A sheet conveying apparatus, comprising:

conveying means for holding a stack of sheets which are deviated stepwisely in a predetermined direction and for conveying the stack in the predetermined direction;

feeding means for receiving the sheet from said conveying means and feeding it, said feeding means being disposed away from said conveying means toward downstream with respect to the predetermined direction by a distance shorter than a length of the sheet measured along the predetermined direction;

detecting means for detecting passage of a trailing edge of a sheet which is most downstream with respect to the predetermined direction through said conveying means; and control means for controlling said conveying means and said feeding means to stop said conveying means and to start said feeding means on the basis of detection by said detecting means.

40. An apparatus according to claim 39, wherein said control means controls said conveying means and said feeding means to start said feeding means after stopping said conveying means.

41. An apparatus according to claim 39, wherein said control means controls said conveying means to receive and convey the sheet and to stop said conveying means when a leading edge of the sheet reaches a predetermined position which is away from said conveying means toward downstream by a predetermined distance, each time the sheet comes to said conveying means.

42. An image forming apparatus, comprising:

means for forming an image on a sheet;

first conveying means for conveying in a predetermined direction the sheet on which the image is formed by said image forming means;

second conveying means for receiving the sheet conveyed by said first conveying means and for further conveying it;

detecting means for detecting passage of a trailing edge of the sheet being conveyed in the predetermined direction through said first conveying means;

control means for controlling said second conveying means to convey the sheet in the predetermined direction; to stop the sheet, after said detecting means detects the passage of the trailing edge, when an edge of the sheet opposite to the trailing edge reaches a position which is away from said second conveying means by a first predetermined distance toward downstream with respect to the predetermined direction; to convey the sheet in the direction opposite to the predetermined direction; and to stop the sheet when the opposite edge of the sheet reaches a position which is away from said second conveying means by a second predetermined distance toward downstream with respect to the predetermined direction; and third conveying means for receiving the sheet from said second conveying means and for conveying it to said image forming means.

43. An image forming apparatus, comprising:

means for forming an image on a sheet;

first conveying means for conveying in a predetermined direction the sheet on which the image is formed by said image forming means;

second conveying means for receiving the sheet from said first conveying means and for further conveying it;

means for detecting passage of the sheet at a predetermined position;

control means for controlling said second conveying means to operate said second conveying means to convey the sheet in the predetermined direction, on the basis of the detection by said detecting means, after a loop of the sheet is formed by a leading edge of the sheet being conveyed by said first conveying means being abutted to said second conveying means, and for controlling the second conveying means to stop said second conveying means when the leading edge of the sheet reaches a position which is away from said second conveying means by a predetermined distance toward downstream with respect to the predetermined direction; and third conveying means for receiving the sheet from said second conveying means and for conveying it to said image forming means.

44. An image forming apparatus, comprising:

means for forming an image on a sheet;

first conveying means for conveying in a predetermined direction the sheet on which the image is formed by said image forming means;

second conveying means for receiving and further conveying the sheet from said first conveying means;

trailing edge detecting means for detecting passage of a trailing edge of the sheet, which is being conveying in the predetermined direction, through said first conveying means;

leading edge detecting means for detecting when a leading edge of the sheet, which is being conveyed in the predetermined direction, reaches a predetermined position; and control means for controlling said second conveying means to stop it on the basis of detection by said trailing edge detecting means and to start said second conveying means to convey the sheet in the predetermined direction of the basis of detection by said leading edge detecting means; and third conveying means for receiving the sheet from said second conveying means and for conveying it to said image forming means.

45. An image forming apparatus, comprising:

means for forming an image on a sheet;

a first passage for conveying the sheet on which the image is formed by said image forming means;

conveying means for receiving the sheet from said first passage, for holding a plurality of the sheets and for conveying the sheets in a predetermined direction;

feeding means for receiving the sheet from said conveying means and feeding it, said feeding means being disposed away from said conveying means toward downstream with respect to the predetermined direction by a distance shorter than a length of the sheet measured along the predetermined direction;

first control means for controlling said conveying means to receive and convey the sheet and to stop said conveying means when a leading edge of the sheet reaches a predetermined position which is away from said conveying means toward downstream by a predetermined distance, each time the sheet comes to said conveying means;

detecting means for detecting passages through said conveying means of a trailing edge of sheets most downstream with respect to the predetermined direction;

second control means for controlling said conveying means and said feeding means to start conveyance of said conveying means after said conveying means holds a plurality of the sheets, and to stop said conveying means and to start said feeding means on the basis of detection by said detecting means; and a second passage for guiding the sheet from said feeding means to said image forming means.

46. An apparatus according to claim 45, further comprising switching means for selectively passing the sheet in said first passage through a first path wherein the orientation of the sheet is reversed and a second path wherein it is not reversed.

* * * * *

UNITED STATES PATENT AND TRADEMARK OFFICE

CERTIFICATE OF CORRECTION

PATENT NO. : 4,873,547

DATED : October 10, 1989

INVENTOR(S) : NOBUKAZU SASAKI, ET AL.

It is certified that error appears in the above-identified patent and that said Letters Patent is hereby corrected as shown below:

COLUMN 1, line 16, "sides" should read --side--;

line 22, "side" should read --sides--;

line 55, "stepwisely." should read --stepwise.--.

COLUMN 2, line 8, "stepwisely" should read --stepwise--;

line 20, "stepwisely" should read --stepwise--;

line 25, "wisely" should read --wise--;

line 26, "by" should read --to--;

line 35, "stepwisely" should read --stepwise--;

line 42, "wisely" should read --wise--;

line 51, "an forming" should read --an image forming--;

line 56, "view of" (first occurrence) should be deleted.

Figure 11A:
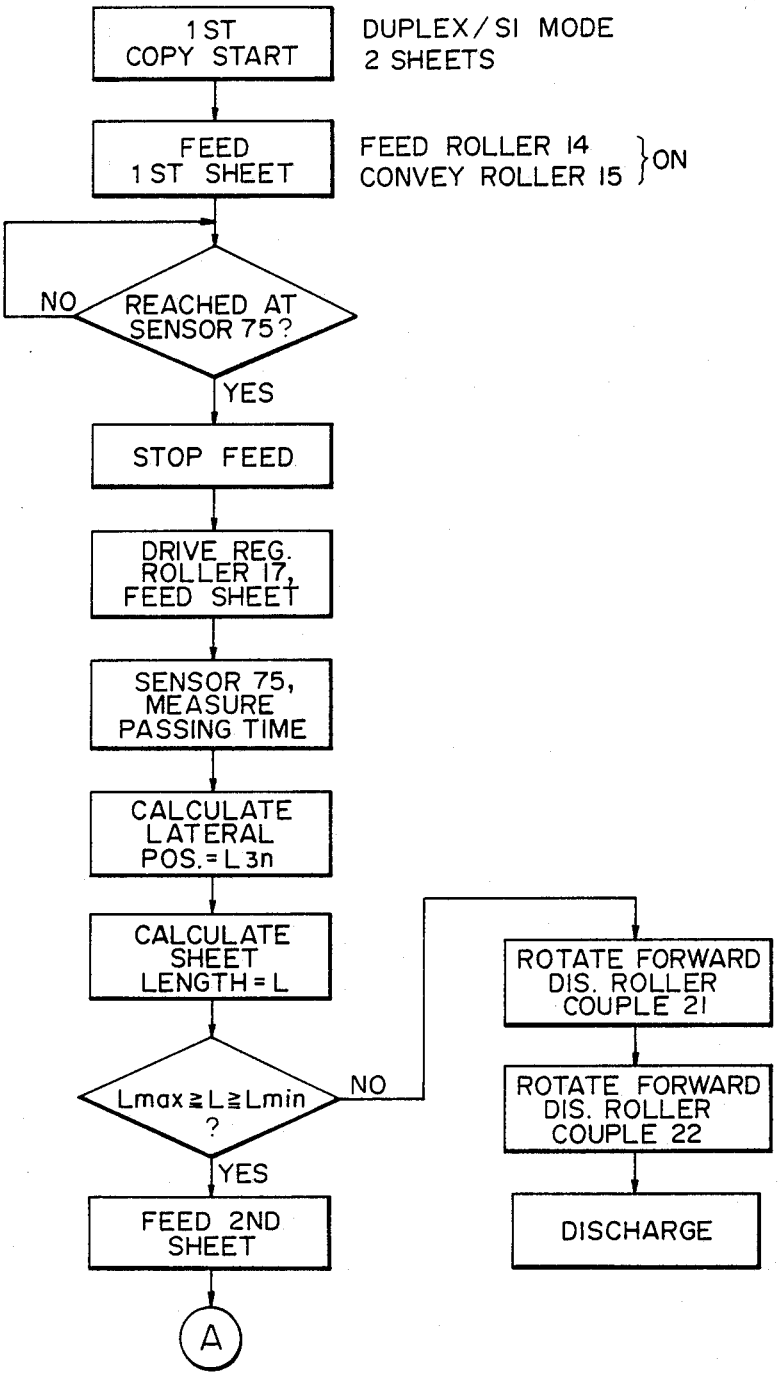
FIG. 11A–FIG. 11E are flow charts illustrating operations of the sheet conveying apparatus according to the first embodiment.
Figure 11B:
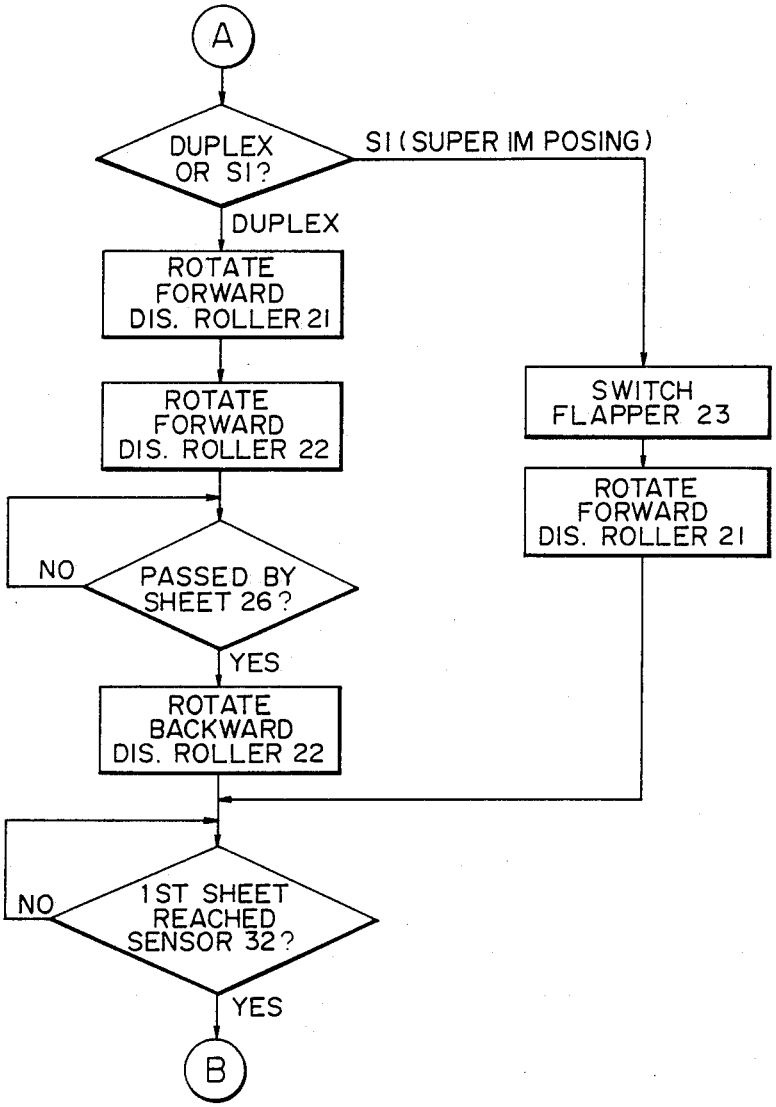
Figure 11C:
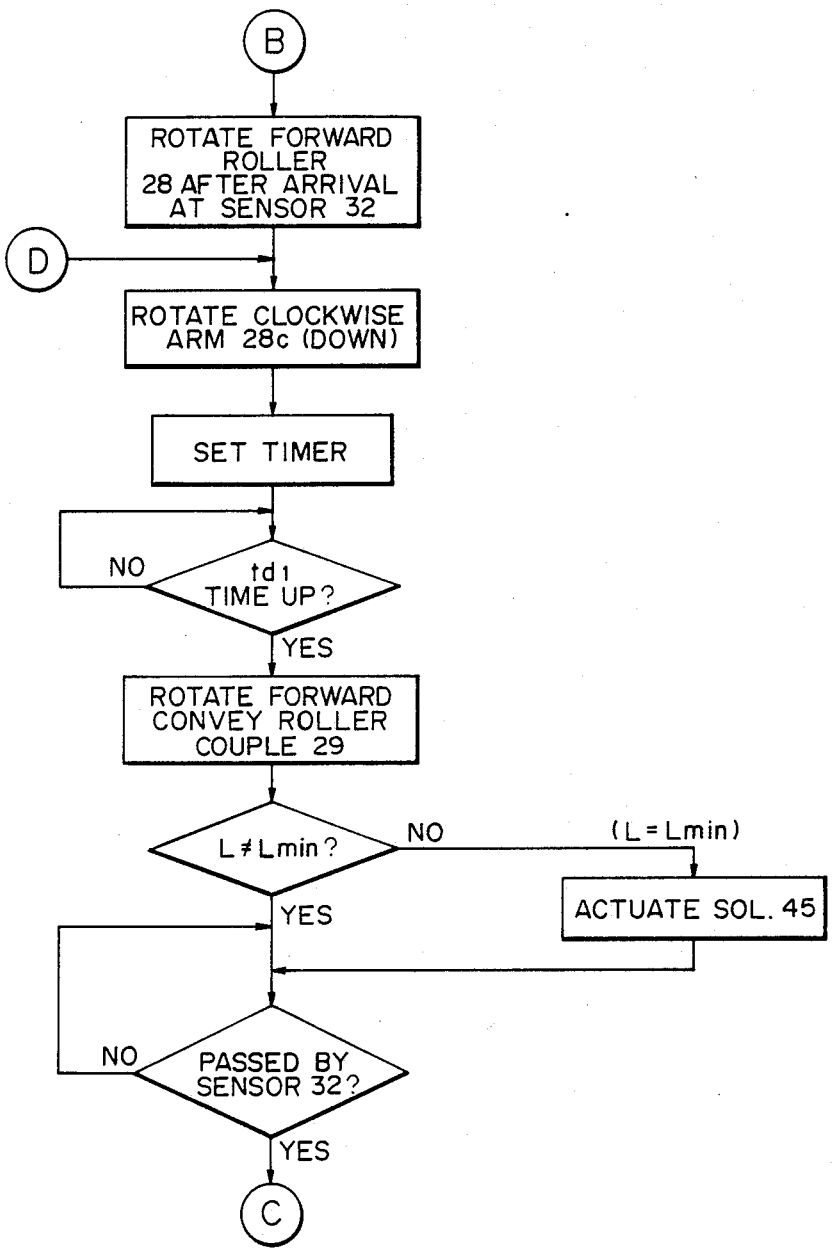
Figure 11D:
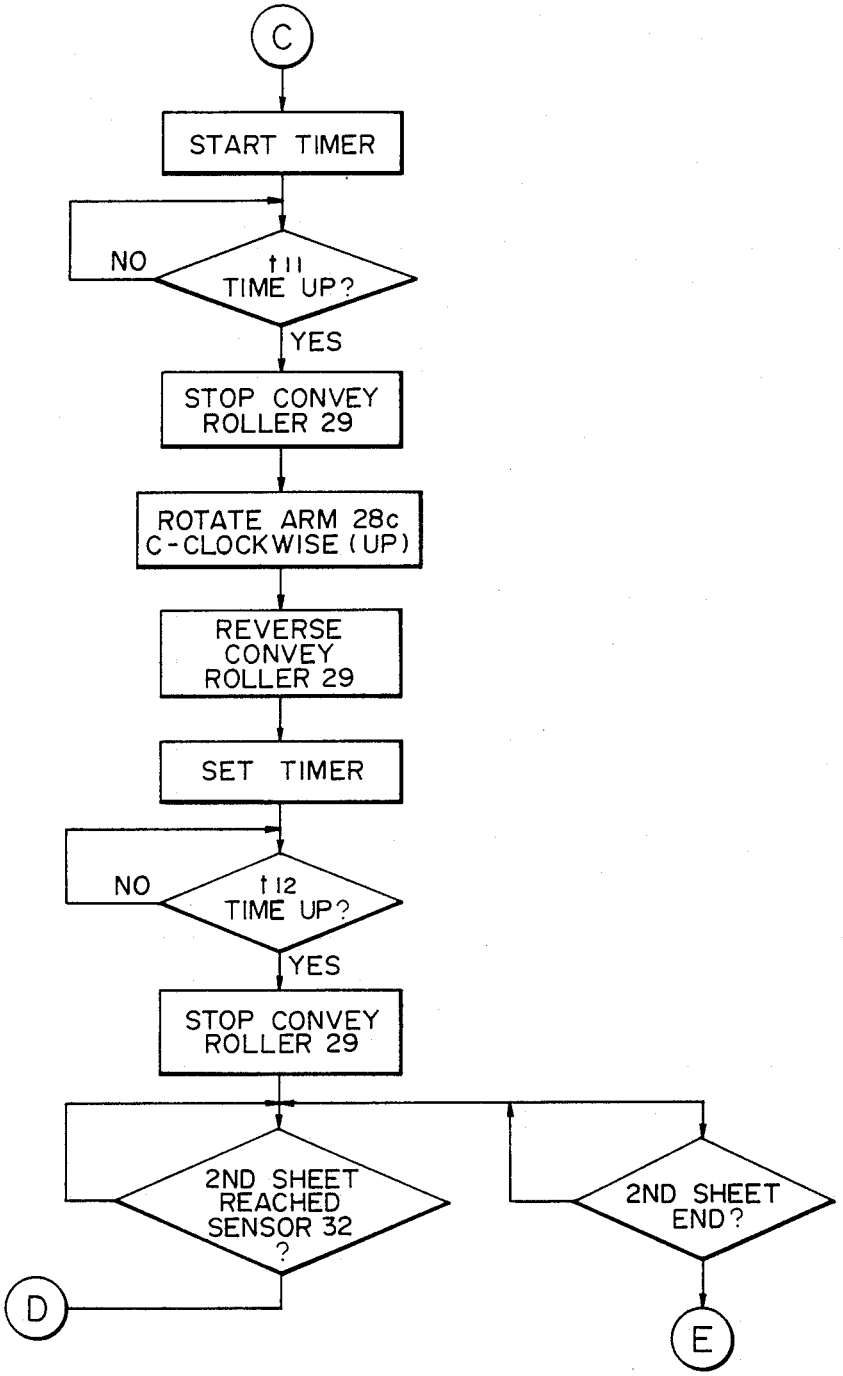
Figure 11E:
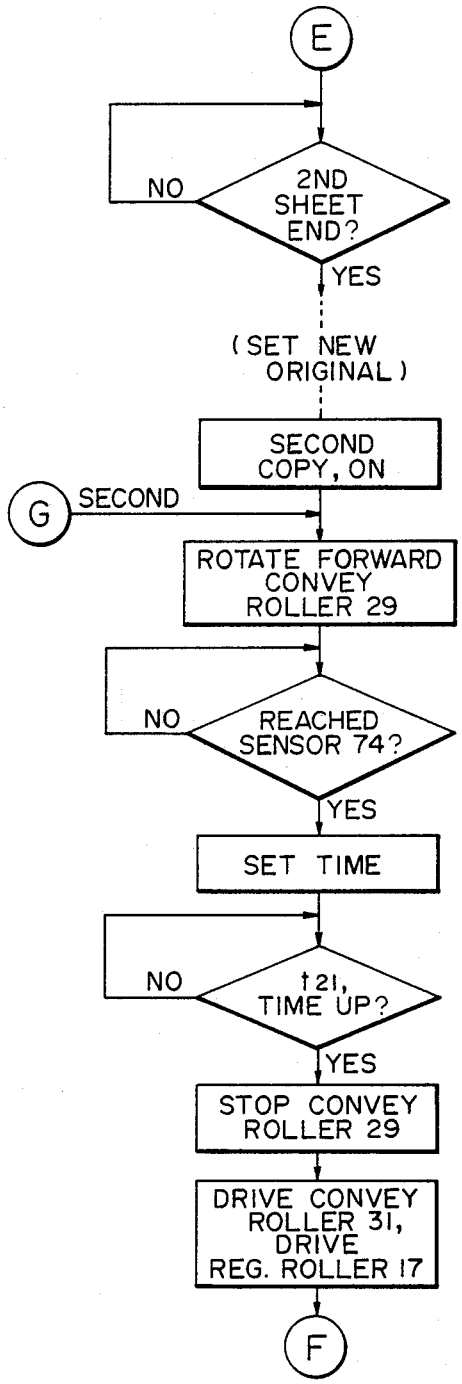
Figure 11F:
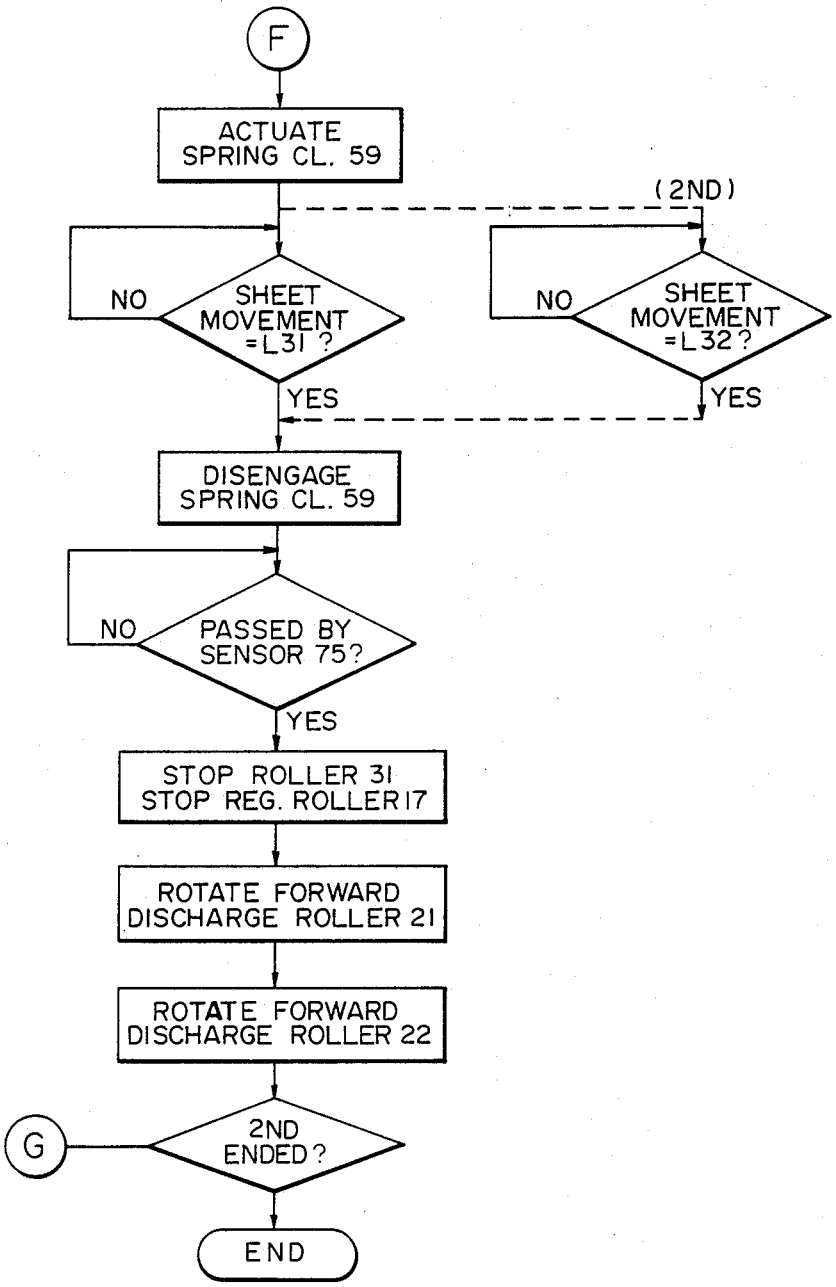

COLUMN 3, line 4, "FIG. 11E" should read --FIG. 11F--;

line 8, "image apparatus" should read --image forming apparatus--;

line 16, "tem sheet" should read --tem for the sheet--.

UNITED STATES PATENT AND TRADEMARK OFFICE

CERTIFICATE OF CORRECTION

PATENT NO. : 4,873,547 Sheet 2 of 6

DATED : October 10, 1989

INVENTOR(S) : NOBUKAZU SASAKI, ET AL.

It is certified that error appears in the above-identified patent and that said Letters Patent is hereby corrected as shown below:

COLUMN 4, line 18, "that" should read --the--;

line 19, "the" should read --that--;

line 21, "instance" should read --instant--.

COLUMN 5, line 9, "29" should read --29a--.

COLUMN 6, line 25, "31a" should read --31b--;

line 26, "31b" should read --31a--;

line 34, "cam member 59" should read --cam member 57--;

line 48, "shaft 67" should read --shaft 69--;

line 60, "element" should read --elements--.

COLUMN 7, line 35, "Superimposinq" should read --Superimposing--.

COLUMN 8, line 61, "7" should read --71--.

COLUMN 9, line 41, "predetermined" should read --predetermined period--;

line 60, "counterclockwisely" should read --counter-clockwise--.

UNITED STATES PATENT AND TRADEMARK OFFICE

CERTIFICATE OF CORRECTION

PATENT NO. : 4,873,547 Sheet 3 of 6

DATED : October 10, 1989

INVENTOR(S) : NOBUKAZU SASAKI, ET AL.

It is certified that error appears in the above-identified patent and that said Letters Patent is hereby corrected as shown below:

COLUMN 10, line 5, "clockwisely" should read --counterclockwise--;

line 47, "instance" should read --instant--;

line 50, "abuts" should read --abutting--;

line 54, "being" should read --is--.

COLUMN 11, line 8, "clockwisely." should read --clockwise.--;

line 13, "states." should read --state.--.

COLUMN 12, line 43, "lowered" should read --forward--;

line 46, "stepwisely" should read --stepwise--;

line 47, "39" should read --31--;

line 50, "stepwisely" should read --stepwise--.

COLUMN 13, line 10, "portion b" should read --portion 71b--;

line 11, "slip roller couple 133" should read --slip roller couple 137--;

line 19, "are" should read --is--;

line 31, "137" should read --135--.

UNITED STATES PATENT AND TRADEMARK OFFICE

CERTIFICATE OF CORRECTION

PATENT NO. : 4,873,547 Sheet 4 of 6

DATED : October 10, 1989

INVENTOR(S) : NOBUKAZU SASAKI, ET AL.

It is certified that error appears in the above-identified patent and that said Letters Patent is hereby corrected as shown below:

COLUMN 14, line 1, "7" should read --71--;

line 10, "and stopped," should read --are stopped,--;

line 17, "are" should read --is--;

line 44, "133f" should read --133s--;

line 45, "leading 1" should read --leading edge--;

line 54, "stepwisely" should read --stepwise--;

line 58, "ing roller couple" should read --ing roller couple 133--.

COLUMN 15, line 42, "T8" should read --ΔT8--;

line 66, "instance" should read --instant--.

COLUMN 16, line 36, "roller 138" should read --roller couple 138--;

line 54, "ple" should read --ple 139--.

COLUMN 17, line 16, "sheet" should read --sheets--.

UNITED STATES PATENT AND TRADEMARK OFFICE

CERTIFICATE OF CORRECTION

PATENT NO. : 4,873,547 Sheet 5 of 6

DATED : October 10, 1989

INVENTOR(S) : NOBUKAZU SASAKI, ET AL.

It is certified that error appears in the above-identified patent and that said Letters Patent is hereby corrected as shown below:

COLUMN 18, line 2, "conveyed first" should read --conveyed by first--;

line 53, "and" should read --an--.

COLUMN 20, line 15, "ber." should read --bers.--;

line 29, "at" should read --a--.

COLUMN 21,

Claim 36, lines 22 through 36 should be deleted and the following claim should be inserted:

--36. An apparatus according to Claim 35, wherein said control means controls said second conveying means to start it on the basis of the detection by said leading edge detecting means, and then stops it when it conveys the sheet through a predetermined distance.--

UNITED STATES PATENT AND TRADEMARK OFFICE

CERTIFICATE OF CORRECTION

PATENT NO. : 4,873,547 Sheet 6 of 6

DATED : October 10, 1989

INVENTOR(S) : NOBUKAZU SASAKI, ET AL.

It is certified that error appears in the above-identified patent and that said Letters Patent is hereby corrected as shown below:

COLUMN 21, line 39, "stepwisely" should read --stepwise--;

line 59, "stepwisely" should read --stepwise--.

Signed and Sealed this

Eighteenth Day of December, 1990

*Attest:*

HARRY F. MANBECK, JR.

*Attesting Officer*

*Commissioner of Patents and Trademarks*